US012392228B2

(12) United States Patent
Knight et al.

(10) Patent No.: US 12,392,228 B2
(45) Date of Patent: Aug. 19, 2025

(54) SELF-ORIENTING PERFORATING GUN

(71) Applicant: G&H Diversified Manufacturing LP, Houston, TX (US)

(72) Inventors: Benjamin Vascal Knight, Katy, TX (US); James Edward Kash, Houston, TX (US); Ryan Ward, Tomball, TX (US); Brian Auer, Houston, TX (US); Timmothy Lee, Tomball, TX (US); Steven Zakharia, Houston, TX (US); Joe Noel Wells, Lindale, TX (US); Adam Green, Houston, TX (US); David Griffin, Houston, TX (US); Christina Matthews, Houston, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 32 days.

(21) Appl. No.: 18/216,232

(22) Filed: Jun. 29, 2023

(65) Prior Publication Data

US 2024/0003200 A1 Jan. 4, 2024

Related U.S. Application Data

(60) Provisional application No. 63/454,595, filed on Mar. 24, 2023, provisional application No. 63/407,047, filed on Sep. 15, 2022, provisional application No. 63/356,938, filed on Jun. 29, 2022.

(51) Int. Cl.
*E21B 43/119* (2006.01)
*E21B 43/117* (2006.01)

(52) U.S. Cl.
CPC ..... *E21B 43/117* (2013.01); *E21B 43/119* (2013.01)

(58) Field of Classification Search
CPC ..... E21B 43/119
See application file for complete search history.

(56) References Cited

U.S. PATENT DOCUMENTS

| | | | | |
|---|---|---|---|---|
| 9,115,572 | B1 * | 8/2015 | Hardesty | E21B 43/119 |
| 11,674,371 | B1 * | 6/2023 | Bradley | E21B 43/117 89/1.15 |
| 2020/0284126 | A1 * | 9/2020 | Mauldin | E21B 43/119 |
| 2023/0203923 | A1 * | 6/2023 | Eitschberger | E21B 43/119 166/297 |
| 2024/0352832 | A1 * | 10/2024 | Sullivan | E21B 43/116 |
| 2024/0418061 | A1 * | 12/2024 | Bradley | E21B 43/117 |

* cited by examiner

*Primary Examiner* — Giovanna Wright
(74) *Attorney, Agent, or Firm* — Conley Rose, P.C.

(57) ABSTRACT

A self-orienting perforating gun includes an outer housing having a throughbore, a charge carrier positioned in the throughbore of the outer housing, a hub secured directly or indirectly to the outer housing, a bearing secured to each carrier end of the charge carrier wherein the bearing overlies the hub to provide a rotatable relationship between the hub and the charge carrier about a rotational axis within the outer housing, and an eccentric weight coupled to the charge carrier applying an off-axis orienting force to the charge carrier for urging the charge carrier to rotate about the rotational axis toward a predefined orientation relative to the direction of gravity.

25 Claims, 35 Drawing Sheets

SELF-ORIENTING PERFORATING GUN

CROSS-REFERENCE TO RELATED APPLICATIONS

This application claims benefit of U.S. provisional patent application Ser. No. 63/356,938 filed Jun. 29, 2022, and entitled "Self-Orienting Perforating Gun," U.S. provisional patent application Ser. No. 63/407,047 filed Sep. 15, 2022, and entitled "Self-Orienting Perforating Gun," and U.S. provisional patent application Ser. No. 63/454,595 filed Mar. 24, 2023, and entitled "Self-Orienting Perforating Gun," each of which is hereby incorporated herein by reference in its entirety for all purposes.

STATEMENT REGARDING FEDERALLY SPONSORED RESEARCH OR DEVELOPMENT

Not applicable.

BACKGROUND

Subterranean wellbores may be drilled into hydrocarbon bearing, earthen formations in the interest of producing hydrocarbons from the wellbore. During completion operations for subterranean wellbores, it is conventional practice to install a tubular casing string in the wellbore and then perforate the casing string with perforating guns along the hydrocarbon bearing formation to provide many paths for formation fluids (e.g., hydrocarbons) to flow into a central passage of the casing string.

Typically, for a wellbore drilled for a long horizontal run along the hydrocarbon bearing formation, the wellbore is planned with many production zones along a horizontal run of more than a mile through what is sometimes referred to as a "tight" formation where the hydrocarbons available for production do not flow very freely. To ensure that each perforation in the casing string leads to a productive area within the hydrocarbon bearing formation, the perforations are subject to a hydraulic fracturing or "fracking" process where high pressure fluids and proppant are pumped into the casing string to enlarge and extend the fractures created by the perforation guns and to create deeper and more extensive paths to dramatically increase contact area therein and thereby productivity.

In some applications, it is desirable to form the perforations made by the perforating guns at one or more predefined angular orientations relative to straight up vertical along the long generally horizontal section of the well. Essentially, an operator may know of pre-existing fractures or the vertical location of the wellbore relative to the vertical extent of the hydrocarbon bearing formation (such as being low or high in the formation) and may desire to puncture and frack straight up, straight down, horizontally out both sides of the borehole or at some other angle relative to vertical. In this way, the longitudinal axis of the wellbore can be seen as the center of a clockface and the preferred angle may be described as a time on the clock or at the angle relative to vertical. As just one example, it may be desired to align the perforations formed by the perforating guns with a preferred fracture plane of the earthen formation through which the wellbore extends. A preferred fracture plane of the earthen formation may define a path of least resistance resulting from varying formation stresses. Aligning the perforations with a preferred fracture plane of the earthen formation may reduce or minimize tortuosity along wellbore fluid flowpaths extending from the earthen formation (in the direction of the preferred fracture plane of the earthen formation) and into the perforations formed by the perforating guns. By minimizing tortuosity in the wellbore fluid flowpaths extending into the perforations from the earthen formation, the resistance to flow of wellbore fluids along the wellbore fluid flowpaths may in-turn be minimized and production of the wellbore fluids into the wellbore from the earthen formation is maximized.

It may be understood that aligning the perforations with a preferred fracture plane of the earthen formation is but one example of why an operator of a completion system would prefer to form the perforations made by the perforating guns in a predefined angular orientation relative to a longitudinal axis of the wellbore. As another example, it may be preferred to orient the perforations in a direction extending away from a downhole tool (separate from the tool string) positioned in the wellbore adjacent the perforating gun. In other words, in some instances an additional downhole tool such as a downhole cable (e.g., a fiber cable) may be present in the wellbore along with the tool string comprising the perforating gun. Of course, it is desired to avoid firing the perforating gun in the direction of an additional downhole tool present in the wellbore as doing so may potentially damage or destroy the downhole tool. Thus, it may be desired to orient the perforations formed by the perforating gun such that they do not interfere or align with an additional downhole tool present in the wellbore so as to avoid damaging the downhole tool.

Past efforts for aligning guns have focused on weight bars to turn the entire gun string in the desired orientation. Apparently, weight bars have not proven very effective at orienting guns with sufficient accuracy even with a wide range of acceptable deviation such as +/−20 degrees. Moreover, after the first guns in the tool string have been fired, the guns tend to deform in ways that make the guns roll over and actually shoot the perforations at far less desired angles. The industry desires a more effective aiming system that continues to be reliable and cost effective for creating perforations in casing, especially perforations in the long horizontal runs of modern wellbores.

SUMMARY OF THE DISCLOSURE

An embodiment of a self-orienting perforating gun for creating one or more perforations through casing in a wellbore formed in a subterranean earthen formation comprises an outer housing having a throughbore extending between longitudinally opposed housing ends thereof, a charge carrier positioned in the throughbore of the outer housing wherein the charge carrier comprises an elongate body with a pair of longitudinally opposed carrier ends thereof and wherein the charge carrier includes one or more charge receptacles positioned between the opposed carrier ends, a hub secured directly or indirectly to the outer housing at each of the opposed housing ends where the hub extends toward the charge carrier, a bearing secured to each carrier end of the charge carrier wherein the bearing overlies the hub to provide a rotatable relationship between the hub and the charge carrier about a rotational axis within the outer housing, and an eccentric weight coupled to the charge carrier applying an off axis orienting force to the charge carrier for urging the charge carrier to rotate about the rotational axis toward a predefined orientation relative to the direction of gravity. In some embodiments, the bearing comprises a radially outer race fixed to the charge carrier, a radially inner race permitted to rotate relative to the radially outer race about the rotational axis, and one or more bearing elements positioned radially between the radially outer race and the radially inner race. In some embodiments, the rotational axis is defined by the bearing. In certain embodiments, the eccentric weight comprises at least one segment of metal stock. In certain embodiments, the perforating gun further comprises a weight harness shaped to secure the at least one segment of metal stock in a predefined position as part of the charge carrier such that the orienting force exceeds a resistance to rotation of the charge carrier for urging the charge carrier to rotate toward the predefined orientation. In some embodiments, the eccentric weight comprises three or more distinct segments of the metal stock. In some embodiments, the perforating gun further comprises a first electrical connector connected to the outer housing, and a second electrical connector connected to the charge carrier and rotatable relative to the first electrical connector, wherein the first and second connectors are in physical contact with one another such that the physical contact extends no further from the axis of rotation than 0.080 inches.

A self-orienting perforating gun for creating one or more perforations through casing in a wellbore formed in a subterranean earthen formation comprises an outer housing having a throughbore extending between longitudinally opposed housing ends thereof and a hub fixed at each of the housing ends and located at least partially within the throughbore, a charge carrier carried in the throughbore of the outer housing comprising a pair of longitudinally opposed carrier ends and defining one or more charge receptacles, a bearing secured to the charge carrier such that the charge carrier may rotate relative to the outer housing about a rotational axis, wherein a first diameter is defined by an outer diameter of the outer housing and a second diameter, which is less than one half of the first diameter, is defined by a curved slip surface of the bearing located between a radially inner race and a radially outer race of the bearing, the slip surface being coaxial with the rotational axis, and an eccentric weight coupled to the charge carrier applying an orienting force to the charge carrier for urging the charge carrier toward a predefined orientation relative to the direction of gravity. In certain embodiments, the second diameter is less than 40% of the first diameter. In certain embodiments, a third diameter is defined by an outer diameter of the charge carrier, and the second diameter is less than 75% of the third diameter. In some embodiments, the second diameter is less than 75% of the third diameter. In some embodiments, a third diameter is defined by a center of mass of the combination of the charge carrier and the eccentric weight, and wherein the third diameter is greater than the second diameter.

An embodiment of a perforating assembly for forming one or more perforations through casing in a wellbore formed in a subterranean earthen formation comprises a tandem sub comprising a tandem housing having a throughbore extending between longitudinally opposed ends thereof, a bulkhead electrical connector received in the throughbore of the tandem housing, the bulkhead electrical connector configured to provide pressure isolation across the throughbore of the tandem housing and comprising an electrical contact for forming an electrical connection across the bulkhead electrical connector, and a support hub substantially coaxially secured to the tandem housing, a self-orienting perforating gun connectable to the tandem sub, the self-orienting perforating gun comprising an outer housing connectable to one of the ends of the tandem housing, the outer housing having a throughbore extending between longitudinally opposed ends thereof, a charge carrier disposed in the throughbore of the outer housing comprising a pair of longitudinally opposed carrier ends and defining one or more charge receptacles positioned between the opposed carrier ends, wherein the one or more charge receptacles are configured to receive one or more explosive charges, and wherein the weight of the charge carrier is supported by the tandem sub when the perforating gun is connected to the tandem sub, a bearing secured to the charge carrier such that rotation is permitted of the charge carrier relative to the outer housing about a rotational axis, and an eccentric weight coupled to the charge carrier applying an orienting force to the charge carrier for urging the charge carrier toward a predefined orientation relative to the direction of gravity. In certain embodiments, the support hub, the bearing, and the eccentric weight define a rotatable weight of the perforating assembly. In certain embodiments, the bearing is formed integrally with the eccentric weight. In some embodiments, a radially outer race of the bearing connects directly to the eccentric weight. In some embodiments, the support hub is supported by the outer housing. In certain embodiments, the bearing has a bearing diameter measured from one edge of a slip surface to the opposite edge of the slip surface, and the bearing diameter is less than 40 millimeters. In certain embodiments, the bearing diameter is less than 35 mm. In some embodiments, the bearing diameter is at least 15 mm and less than 30 mm.

An embodiment of a self-orienting perforating gun for creating one or more perforations through casing in a wellbore formed in a subterranean earthen formation comprises an outer housing having a throughbore extending between longitudinally opposed housing ends thereof, a charge carrier positioned in the throughbore of the outer housing wherein the charge carrier comprises an elongate body with a pair of longitudinally opposed carrier ends thereof and wherein the charge carrier includes one or more charge receptacles positioned between the opposed carrier ends and configured to receive one or more explosive charges, an axis of rotation for the charge carrier to rotate within the throughbore of the outer housing, a first electrical connector connected to the outer housing, and a second electrical connector connected to the charge carrier and rotatable about the axis of rotation relative to the first electrical connector, wherein the first and second connectors are in physical contact with one another such that the physical contact extends no further from the axis of rotation than 0.080 inches. In some embodiments, the perforating gun further comprises an endplate for attaching to one end of the charge carrier and comprises an axis oriented parallel with the elongate body of the charge carrier along with features formed on and into the endplate, and wherein all of the features formed on and into the endplate have a direction of draw parallel to the axis of the endplate. In certain embodiments, the perforating gun further comprises eccentrically mounted weight bars axially displaced from the explosive charge and a weight cap arranged to support the weight bars at an end of the weight bars closest to the one or more explosive charges. In certain embodiments, the weight cap includes a blast plate between the ends of the weight bars located between the weight bars and the weight cap to provide a barrier against an activation from the one or more explosive charges. In some embodiments, the weight cap includes alignment tabs comprising a first arc of tabs and a separate second arcs of tabs wherein both the first arc of tabs and the second arc of tabs have a shared central axis and the first arc of tabs is arranged at a first radius from the shared central axis and the second arc is arranged to have a larger diameter from the shared central axis.

An embodiment of a self-orienting perforating gun for creating one or more perforations through casing in a wellbore formed in a subterranean earthen formation comprises an outer housing having a throughbore extending between longitudinally opposed housing ends thereof, a charge carrier positioned in the throughbore of the outer housing and comprising an elongate body with a pair of longitudinally opposed carrier ends thereof and wherein the charge carrier comprises one or more charge receptacles positioned between the opposed carrier ends and configured to receive one or more explosive charges, and wherein the charge carrier defines an axis of rotation about which the charge carrier is permitted to rotate within the throughbore of the outer housing, and an electric pin connector supported by the outer housing along the axis of rotation having a length and a width in which the length is at least four times the width, the electric pin connector comprising frangible sections along the length thereof having a reduced bending strength relative to other sections of the electric pin connector.

An embodiment of a self-orienting perforating gun for creating one or more perforations through casing in a wellbore formed in a subterranean earthen formation comprises an outer housing having a throughbore extending between longitudinally opposed housing ends thereof, a charge carrier positioned in the throughbore of the outer housing and comprising an elongate body with a pair of longitudinally opposed carrier ends thereof, one or more charge receptacles positioned between the opposed carrier ends, a bearing assembly attached to each of the longitudinally opposed carrier ends, and a switch in electrical communication with an electrical signal path that extends into the charge carrier from a first of the carrier ends and includes an electrically conductive primary ground path extending back from the switch to the first carrier end. In some embodiments, the perforating gun further comprises an electrically conductive secondary ground path in addition to the primary ground path where an electrical signal may pass parallel to the primary ground path. In certain embodiments, the ground path includes a ground brush arranged in continuous contact with a hub. In certain embodiments, an interface is formed along which the ground brush contacts and slides along the hub whereby the interface has an orientation transverse to a central axis of the perforating gun. In some embodiments, an interface is formed along which the ground brush contacts and slides along the hub whereby the interface has an orientation disposed at a non-zero angle to a central axis of the perforating gun. In some embodiments, the ground path comprises a ground brush having a radially inner end arranged in continuous contact with a longitudinally extending surface.

BRIEF DESCRIPTION OF THE DRAWINGS

For a detailed description of exemplary embodiments of the disclosure, reference will now be made to the accompanying drawings in which.

DETAILED DESCRIPTION

Figure 1:
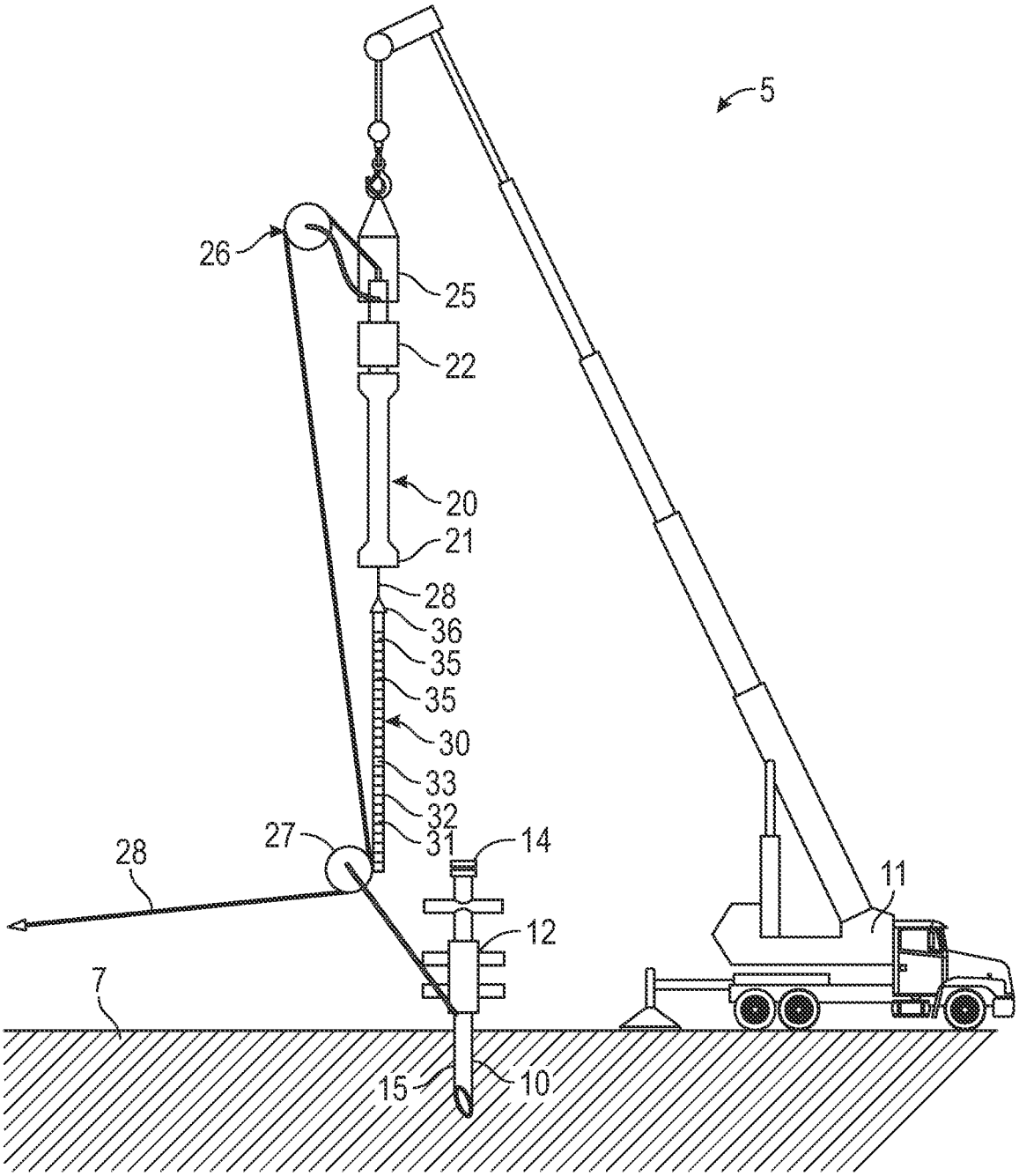
FIG. 1 is an elevation view of a wellsite in the process of putting a plug and perf tool string down into the well.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Figure 3:
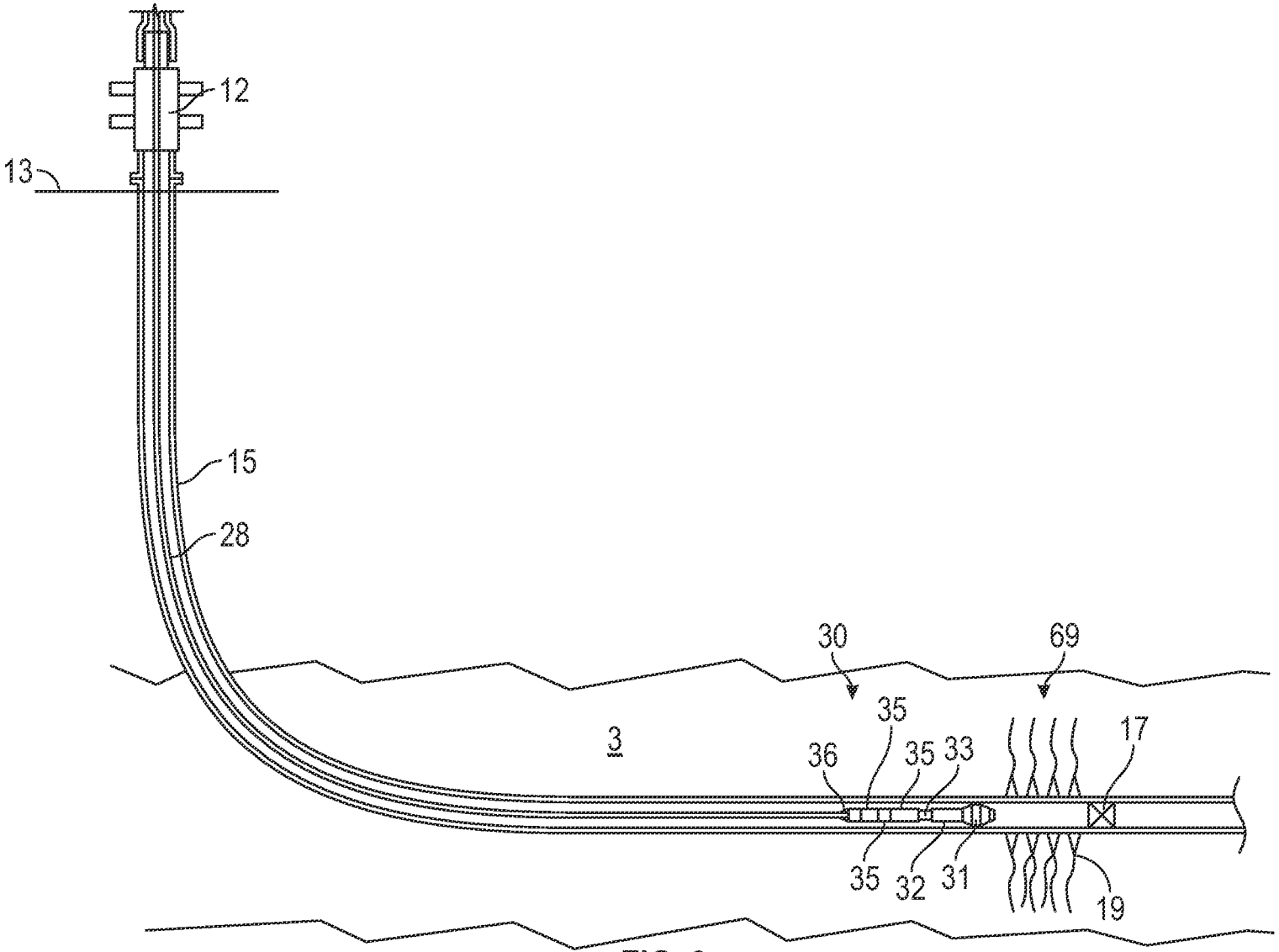
FIG. 3 shows an elevation cross-sectional view of the well with the plug and perf tool string in the extended horizontal segment.

Referring now to FIG. 1, a wireline system 5 is shown for deploying a "plug and perf" tool string 30 into a cased wellbore 10 in which casing 15 (commonly called a casing string) is installed. The view shown in FIG. 1 is near the surface 7 with the cased wellbore 10 extending far into the earth and into an extended generally horizontal run within a prospective hydrocarbon bearing formation 3 (see FIG. 3) deep in the ground. A crane 11 is positioned adjacent the cased wellbore 10 for lifting a wireline lubricator 20 off the top of the valve tree 12 in preparation for lifting a tool string 30 up inside the wireline lubricator 20. Wireline 28 of the wireline system 5 is fed through a wireline sealing element 22 and down through the wireline lubricator 20 to pull the tool string 30 up into the wireline lubricator 20 whereupon the wireline lubricator 20 is then attached onto the top of a valve tree 12. A bottom coupling 21 sealingly connects the lubricator 20 to a coupling 14 at the top of the valve tree 12.

In the configuration shown in FIG. 1, the cased wellbore 10 is sealed by one or more valves of the valve tree 12. As is well known, pressure within cased wellbore 10 must be maintained in a pressure-controlled state at all times so that before any valve is opened, others are closed in a manner that maintains well pressure control. The position of wireline lubricator 20 is controlled by an operator of the crane 11 using a bridle 25 attached to an upper end of the wireline lubricator 20, while the position of tool string 30 is controlled by an operator of a wireline truck (not shown) via the wireline 28. In FIG. 1, the wireline operator has reeled in the wireline 28 to lift the tool string 30 off of the surface 7 into a vertical orientation such that an upper end of the tool string 30 is proximal to the bottom of the wireline sealing element 22 at the bottom end of the wireline lubricator 20. The entire length of tool string 30 must fit fully into the wireline lubricator 20 to allow the bottom coupling 21 of wireline lubricator 20 to sealingly connect to the coupling 14 of valve tree 12 to maintain well pressure control prior to insertion of the tool string 30 into the cased wellbore 10 through the valve tree 12.

The tool string 30 includes a number of tools that are selected by an operator of the cased wellbore 10 and which, in this example, includes a plug 31 at the bottom thereof, an adapter kit 32 and a setting tool 33 where the adapter kit 32 is connected between the plug 31 and setting tool 33. Above the setting tool 33 are a number of perforating or "perf" guns 35 along with other tools that include electronic communication with the setting tool 33 and the perforation guns 35 and other tools of tool string 30 that provide the wellbore location of the tool string 30 as well as other known functions. A tandem sub 50 may be coupled between the perforating guns 35 to provide pressure isolation therebetween. At the top of the tool string 30 is a wireline coupling device 36 that attaches to the wireline 28. The wireline 28 extends from the wireline truck, over a pair of sheaves 26 and 27, and is typically quite long to permit the tool string 30 to run potentially miles down into the cased wellbore 10. It may be generally understood that wellbores, including cased wellbore 10, extend vertically downwards from the surface 7 and then turns along a broad curve to a more horizontal path or portion that is typically a great length (e.g., a mile or more) horizontally through a probable hydrocarbon bearing zone.

Figure 2:
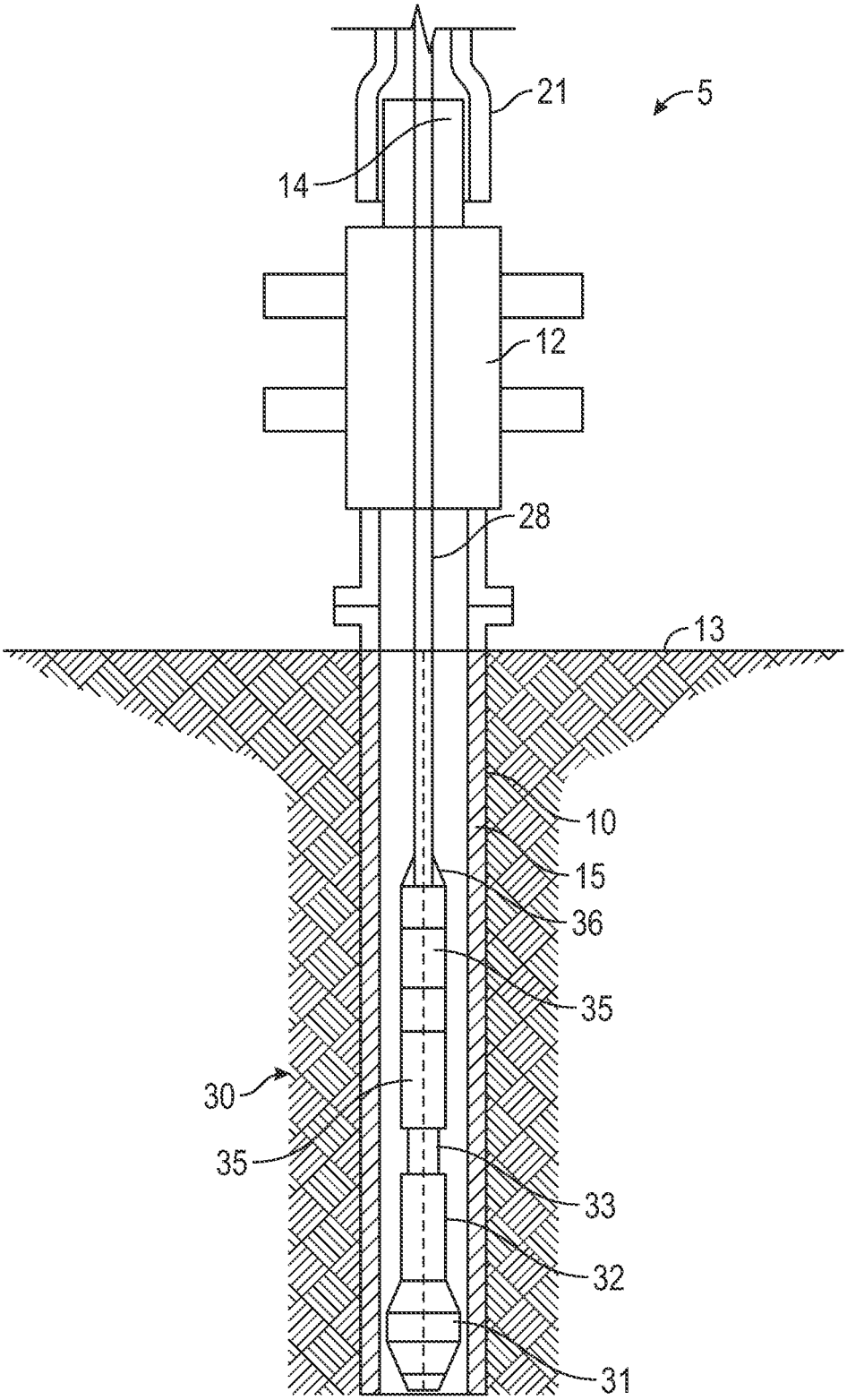
FIG. 2 is an elevation view of the plug and perf tool string in the well and progressing toward the bottom of the wellbore.

Turning to FIG. 2, the tool string 30 is shown within the well 10 below and past the valves in the valve tree 12 such that the tool string 30 is on its decent within a first vertical section where the well is sealed from outside environment by the wireline sealing element 22 at the top of the wireline lubricator 20 (both shown only in FIG. 2). The tool string 30 is lowered and typically pumped down to a generally horizontal section shown in FIG. 3 where the wellbore 10 extends a significant distance along within a prospective hydrocarbon bearing formation 3. Just above the existing perforations 69 that have already been subject to fracking, the plug 31 at the end of the plug and perf tool string is set or deployed to seal against the inside of the casing to isolate the upper portion of the cased wellbore 10 from a lower portion below the plug 31. The plug 31, once set, prevents fluid that will be pumped down from the surface 7 and is intended to frack newly created perforations from escaping into the existing perforations 69 and preventing the needed build in fluid pressure. It takes significant hydraulic pressure to enlarge and extend new perforations so any plug and perf operation begins with plugging off the lower existing perforations such as those shown at 69, separating the set plug from the remainder of the plug and perf tool string so that new perforations may be created in the casing 15 above the set plug 31. Once the plug 31 is disengaged from the tool string 30, the plug and perf tool string lays on the bottom of the horizontal run of the casing 15 and is pulled upwardly toward the surface while each of a number of perforating guns 35 are detonated at predetermined positions to shoot or discharge shaped explosive charges 65 (seen in FIGS. 5, 10, 11, 13, 14, 15 and 19) which puncture the casing 15 thereby creating a perforation.

Figure 4:
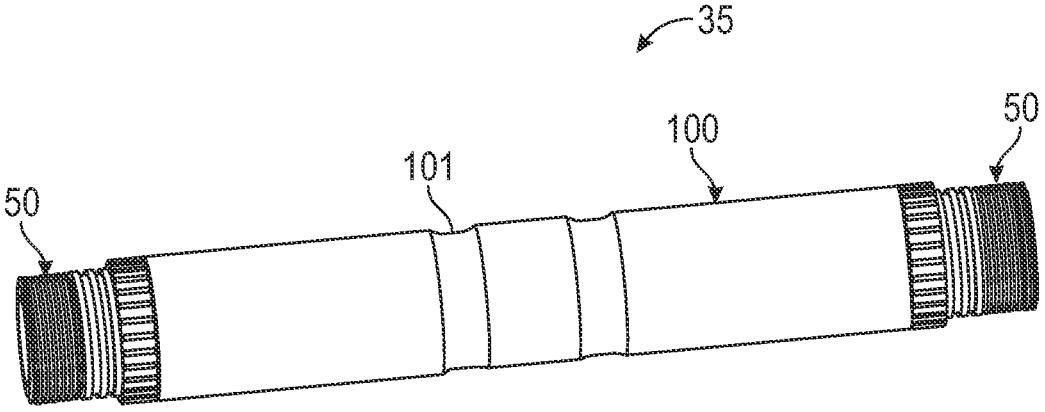
FIG. 4 is a perspective view of the inventive self-orienting perforating gun with tandem subs at each end of the gun housing.

As described above, it may be desired in at least some applications to be able to orient the explosive charges 65 with respect to the horizontal run of the casing 15. Using gravity to orient the perforating guns 35 with respect to a vertically upward direction has been tried with less than satisfactory success so now, the present disclosure relates to a perforating gun 35 that separates the orientation of the outside body of the perforating gun 35 from the orientation of charges inside the perforating gun 35. Perforating gun 35 is shown particularly in FIG. 4 having a generally tubular outer housing 100 that appears much like a conventional perforating gun but with rings 101 machined into the outer housing 100 where a blast from a explosive charge 65 may exit in any direction relative to the outer housing 100. After the blast, there is typically a ragged edge with turned out shards of metal which may drag inside the casing 15 when the tool string 30 is pulled out of the wellbore 10. By machining the rings, the radial extent of those shards is typically less than the unmachined peripheral surface of the outer housing 100 thereby reducing the potential for the spent perforating guns 35 from catching inside the casing 15. The point here is that the aiming or orienting of the explosive charges 65 is independent of the orientation of the outer housing 100 but the outer housing 100 has rings 101 that are prepared for whatever orientation the explosive charges 65 are oriented with respect to the outer housing 100. The perforating gun 35 is connected to other guns in the tool string 30 by tandem subs 50 which are attached by screw threads. It may however be understood that in some embodiments perforating guns 35 (as well as the other perforating guns described herein) may connect directly together rather than via a separate tandem sub 50.

Figure 5:
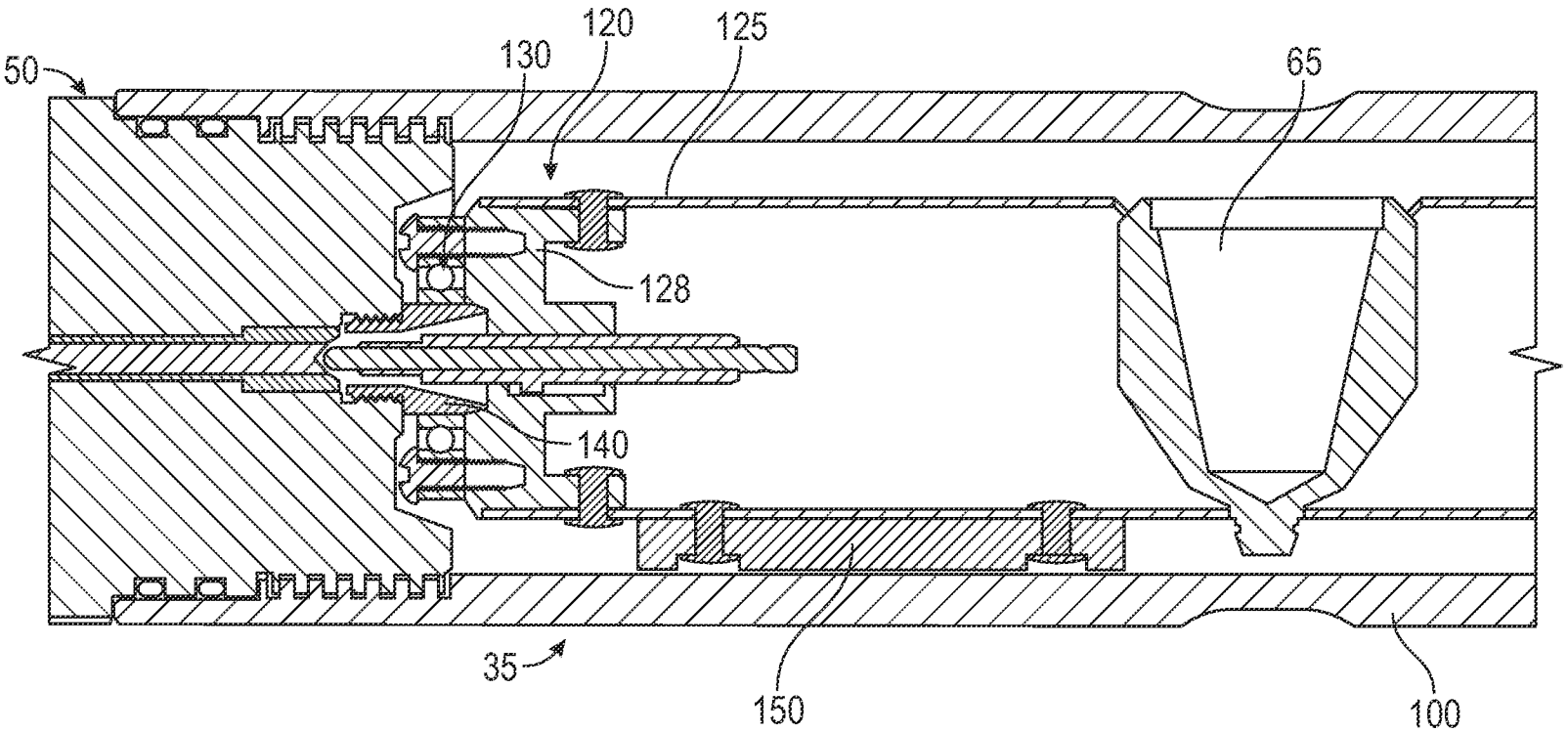
FIG. 5 is fragmentary elevation cross-sectional view of a first embodiment of the self-orienting perforating gun.
Figure 6:
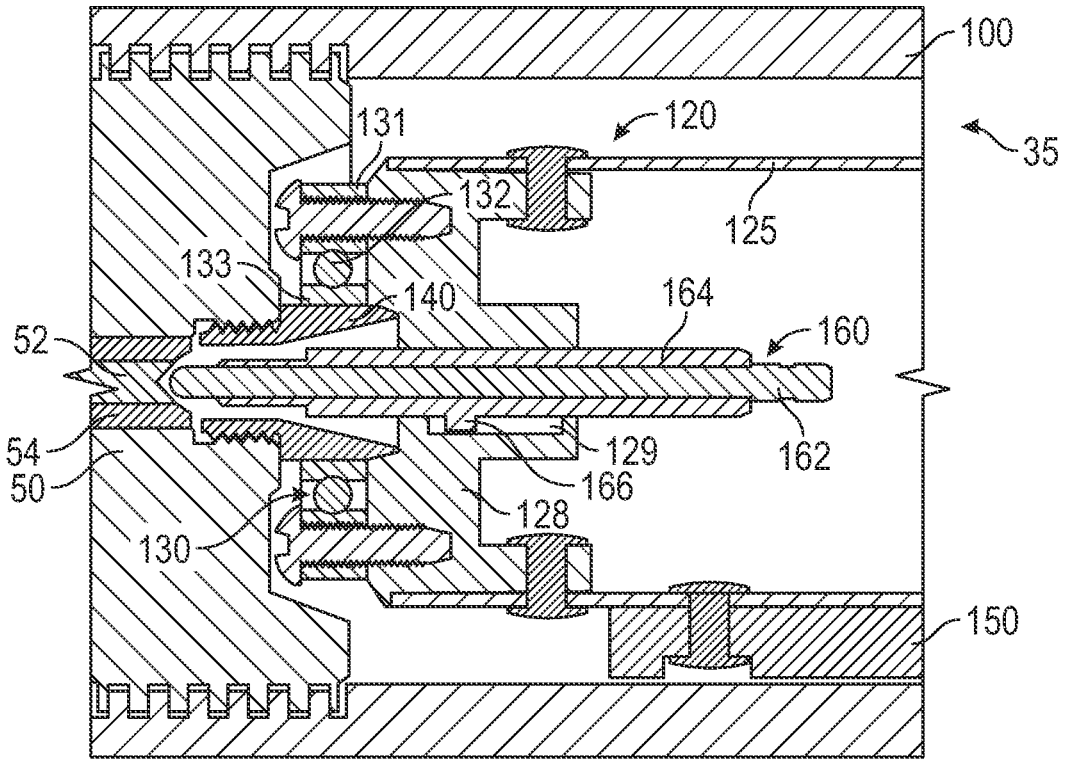
FIG. 6 is an enlarged fragmentary elevation cross-sectional view of the first embodiment of the self-orienting perforating gun shown in FIG. 5.
Figure 7:
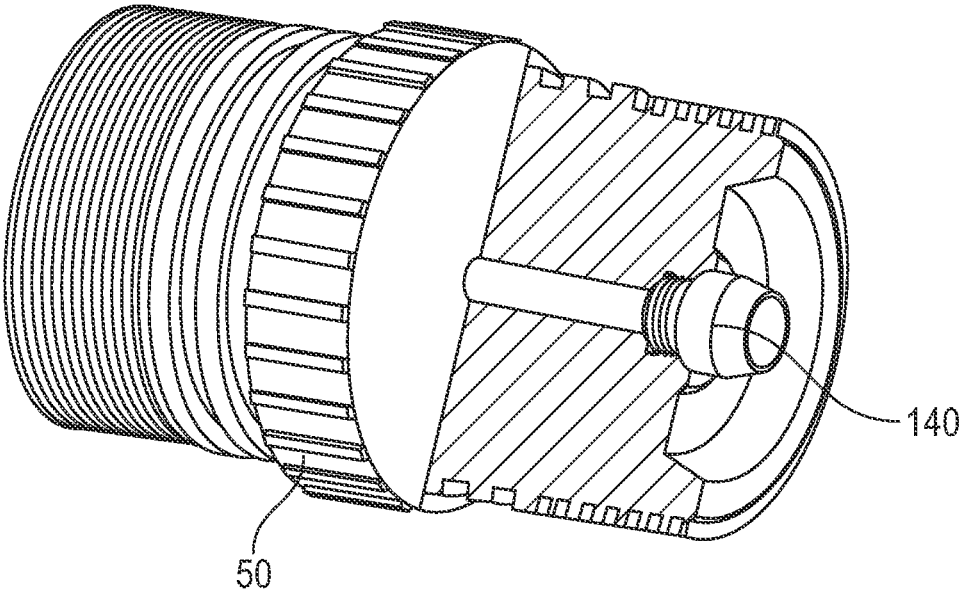
FIG. 7 is a fragmentary perspective view of a tandem sub modified for use with the perforating gun shown in FIGS. 5 and 6.

Turning now to the first embodiment of the self-orienting perforating gun of the present disclosure, FIGS. 5-7, the perforating gun 35 includes the outer housing 100 and a rotating assembly 120 located at least partially in the outer housing 100. The outer housing 100 is, as described above, firmly connected to the tandem subs 50 by screw threads and the outer housing 100 and tandem subs 50 are essentially fixed to one another. With respect to the outer housing 100 and tandem subs 50, the rotating assembly 120 is mounted for essentially free rotation within the outer housing 100. And the rotating assembly 120 principally includes a charge carrier 125 that carries most of the remaining elements of the perforating gun 35 and it is within the rotating assembly 120 that the operations and communications of the perforating guns 35 occur. Rotation of the rotating assembly 120 is principally enabled by a bearing assembly 130. In this exemplary embodiment, the bearing assembly is a roller bearing assembly and as seen in FIG. 6 includes a radially outer race 131, a plurality of rollers 132 and a radially inner race 133. Inner race 133 rides on support hub 140 and the outer race 133 is bolted to the end face of endplate 128. The endplate 128 is fixed to the charge carrier 125 by screws, rivets or other known means. To urge the rotating assembly 120 to turn such that the explosive charges 65 are aimed or oriented in the desired direction, an eccentric weight 150 is secured to the charge carrier 125 at what is desired to be the bottom of the charge carrier 125. In this particular configuration, the explosive charge 65 is aimed straight up, but the operator of a well may have the rotating assembly assembled such that the explosive charge 65 may be aimed in any desired direction principally by where on the charge carrier 125 the eccentric weight 150 is mounted.

In addition to the explosive charges 65, a perforating gun includes an electric circuit for communication with each perforating gun 35 and power for initiating the explosive charges 65. The power and signal side of the electric circuit includes a subbar 52 with a sub insulator 54 overlying the subbar 52 that provides electric power from the surface. In contact with the exposed and conductive end of the subbar 52 is an electrical contact assembly 160 that includes a gun conductor pin 162 with a gun pin insulator 164 overlying and electrically insulating the gun conductor pin 162 from the endplate 128. Attached to the exposed end of the pin inside the charge carrier 125, an electric wire would be attached (not shown) and the circuit would include a switch, a power line to the other end of the perforating gun 35 and a line connecting to either the charge carrier 125 or endplate 128, both of which are preferably part of the ground circuit. The charge carrier 125 would preferably be formed from electrically conductive metal such as steel and would be part of the ground side of the electric circuit of the tool string 30. The ground side principally includes the tandem subs 50 and the outer housing 100, but in this exemplary embodiment would include the support hub 140, the bearing assembly 130, and the endplate 128.

One aspect to note about the inventive design of this embodiment is that the rotating assembly 120 may not contact the outer housing 100 and is supported by the tandem sub 50 through the support hub 140. The support hub 140 has an outer peripheral surface that may fully support an inner race of the bearing assembly 130. Support hub 140 may also have flat portions (like a hex bolt) for a tool to tighten the support hub 140 into the screw threads at the end of the tandem sub 50.

Another feature of the present disclosure is that as the rotating assembly 120 may rotate several times within the outer housing 100 in the process of plugging and perfing a well, the gun electric contact assembly is arranged to rotate relative to the subbar 52 and not rotate with respect to the rotating assembly by the provision of a gun contact key 166 that rides within the plate keyway slot 129. This avoids any issues with tangled wires within the charge carrier 125. FIG. 7 shows the support hub 140 projecting from the end of the sub 50.

Some of the dynamic actions that orient the explosive charges 65 will be discussed below after other embodiments have been described.

Figure 8:
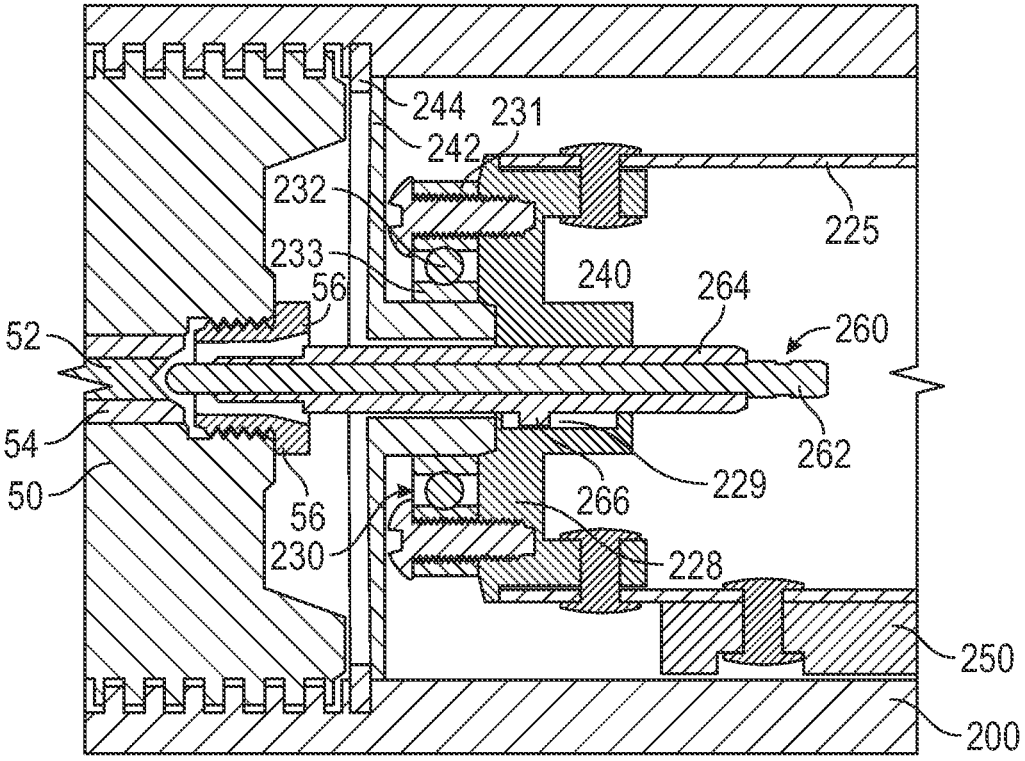
FIG. 8 is an enlarged fragmentary elevation cross-sectional view similar to FIG. 6 but of another embodiment of the self-orienting perforating gun shown in FIG. 5.
Figure 9:
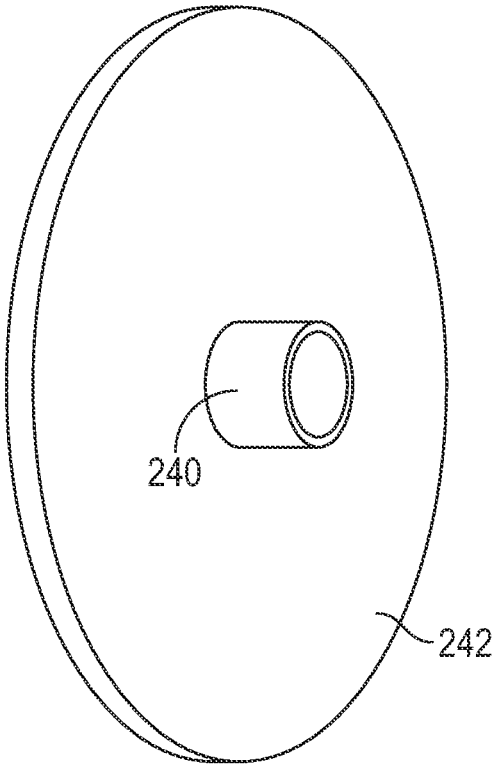
FIG. 9 is a perspective view of a support plate for use with the perforating gun shown in FIG. 8.

Turning now to the second embodiment of the present disclosure shown in FIGS. 8 and 9, there are similarities to the first embodiment in that there is an outer housing 200 (all common elements in the first embodiment are similarly numbered in FIGS. 8 and 9 with the addition of "100" except for the tandem sub 50) with a rotating assembly 220 positioned inside the outer housing 200. One principal difference between this second embodiment and the first is that the inner race 233 of the bearing assembly 230 is carried by a plate hub 240. As seen particularly in FIG. 9, the plate hub 240 includes a hub wheel 242 which may have a disk, plate, or wheel-like configuration with holes or openings (not shown) for viewing and access into the interior of the tubular-shaped outer housing 200. The hub wheel 242 has an outer perimeter sized to fit the inside diameter of the outer housing 200 so that the weight of the rotating assembly 220 is actually carried by the outer housing 200 rather than the tandem sub 50. The hub wheel 242 may be held in a transverse orientation to the outer housing arrangement by the insertion of a hub snap ring 244 into a suitable snap ring channel machined into the interior of the outer housing 200 as seen in FIG. 8. The subbar 52 with the sub insulator 54 would revert to having a hollow retainer nut 56 screwed into the end of the tandem sub 50 to prevent the subbar 52 from escaping the tandem sub 50 before the tool string comprising the tandem sub and self-orienting perforating gun is assembled at the wellsite.

Figure 10:
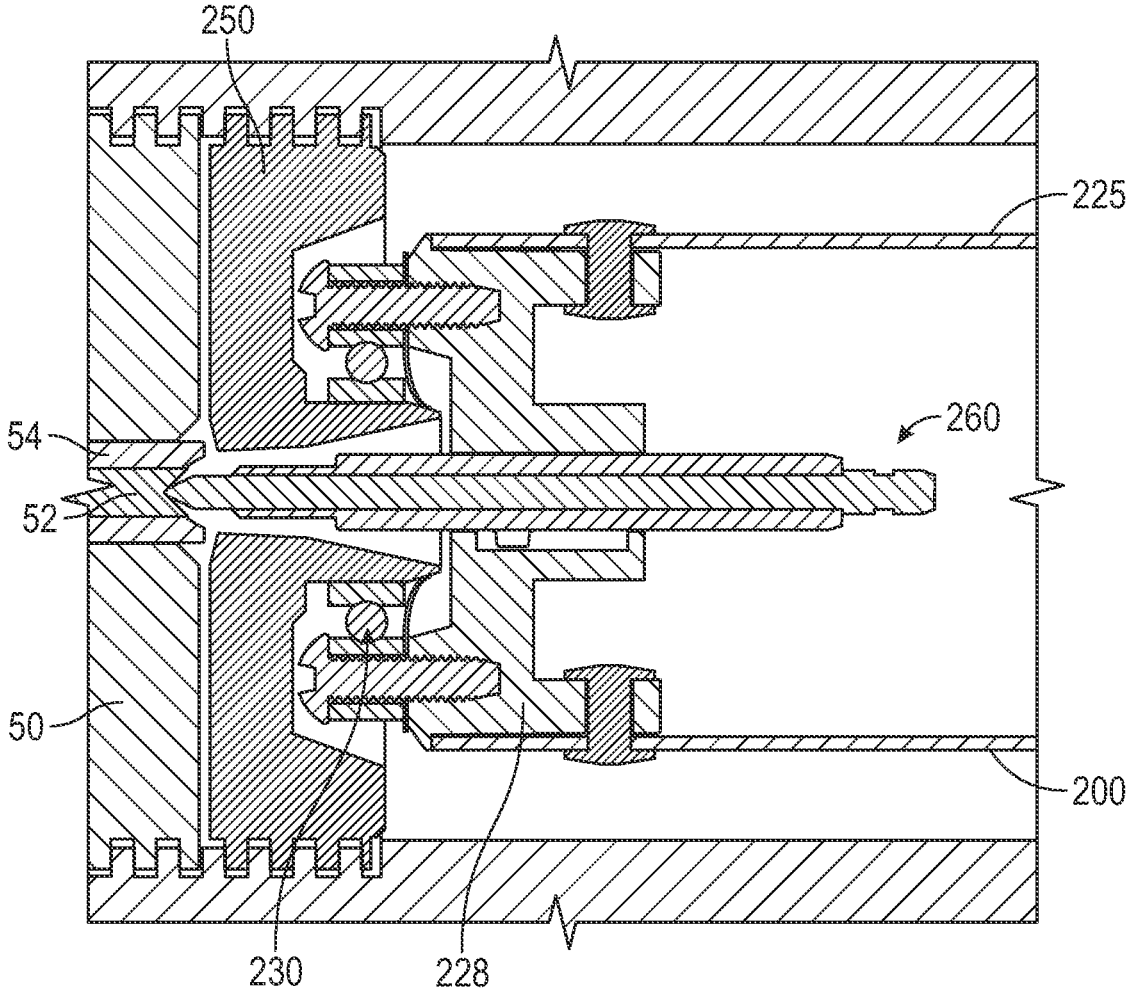
FIG. 10 is an enlarged fragmentary elevation cross-sectional view of another embodiment of the self-orienting perforating gun.
Figure 11:
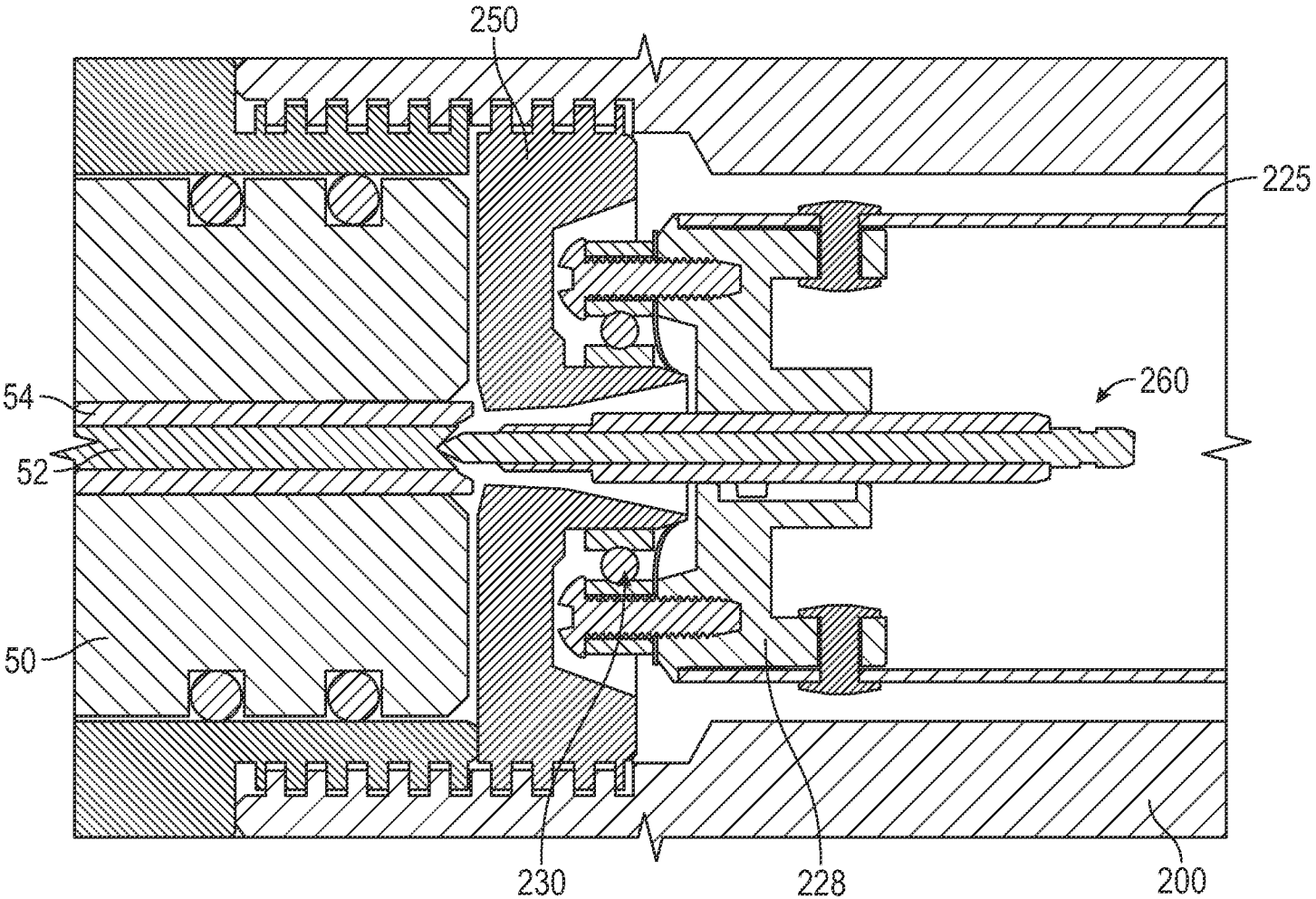
FIG. 11 is an enlarged fragmentary elevation cross-sectional view of another embodiment of the self-orienting perforating gun.

Turning briefly to FIGS. 10 and 11, FIG. 10 illustrates an embodiment is shown including a hub wheel 250 that is externally threaded into internal threads formed on the outer housing 200 whereby a threadable connection is formed between the hub wheel 250 and outer housing 200. Additionally, FIG. 11 illustrates a further embodiment similar to that shown in FIG. 10 except that perforating gun is connected via a box-by-pin arrangement rather than the box-by-box connection shown in FIG. 10.

Figure 12:
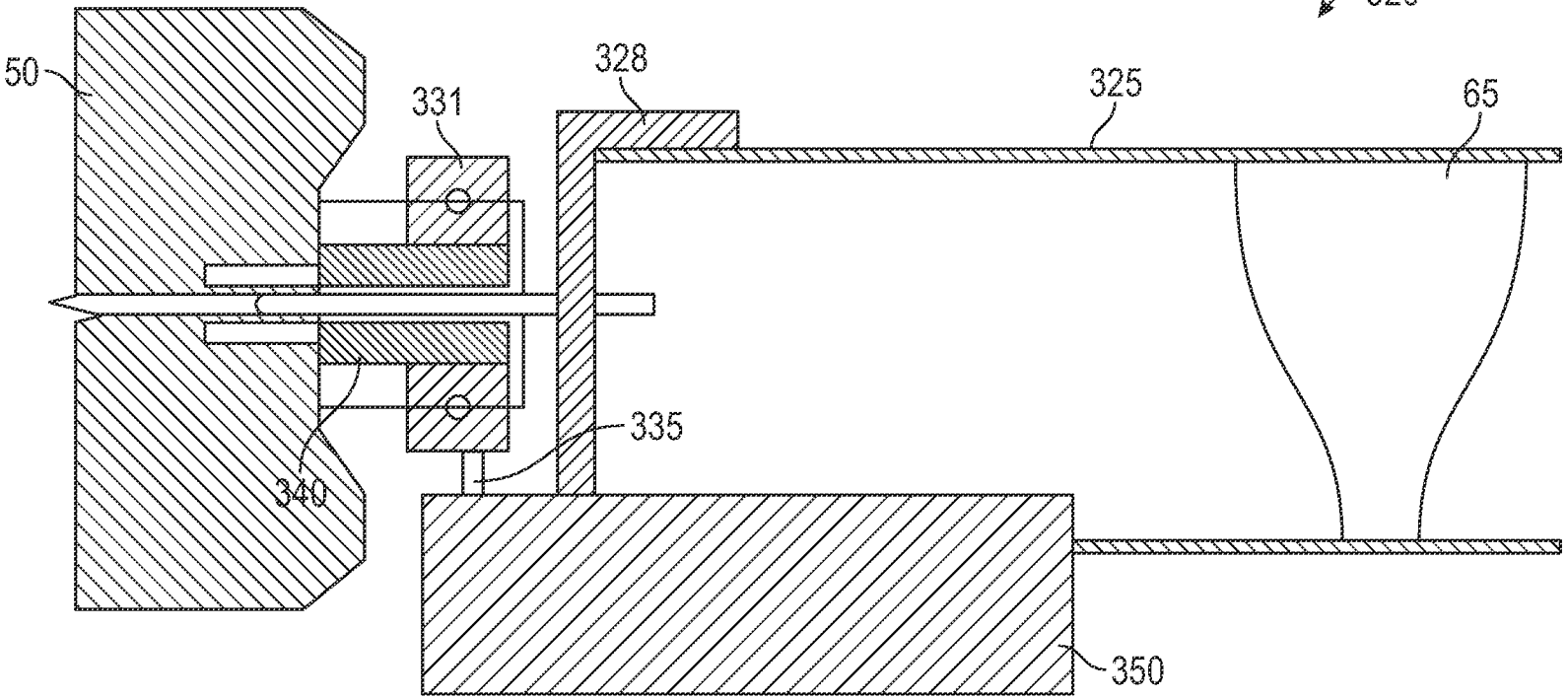
FIG. 12 is an elevation cross-sectional view of another embodiment of the self-orienting perforating gun.

A further or third embodiment is shown in FIG. 12 where common elements are similarly numbered with the addition of another "100" except for the tandem sub 50. The rotating assembly 320 is shown without the outer housing 300 in FIG. 12. The tandem sub 50 is similar to the first embodiment with a support hub 340 screwed into the end thereof and the bearing assembly 330 is carried by the support hub 340. However, the connection of the bearing assembly 330 to the charge carrier 325 is not direct as it was in the first embodiment but rather passes through the eccentric weight 350 which is connected to the bearing assembly 330 by threaded post 335. In this arrangement, gravity pulls the eccentric weight 350 downward creating an orienting torque with the outer race of the bearing assembly 331 and thereby arranges for the explosive charge 65 to rotate toward the desired orientation.

Figure 13:
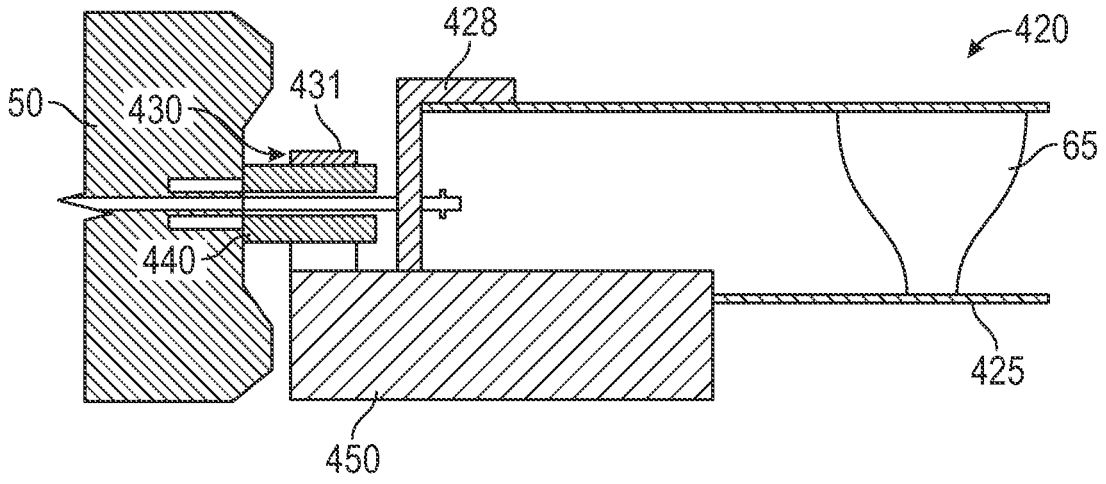
FIG. 13 is an elevation cross-sectional view of another embodiment of the self-orienting perforating gun.
Figure 14:
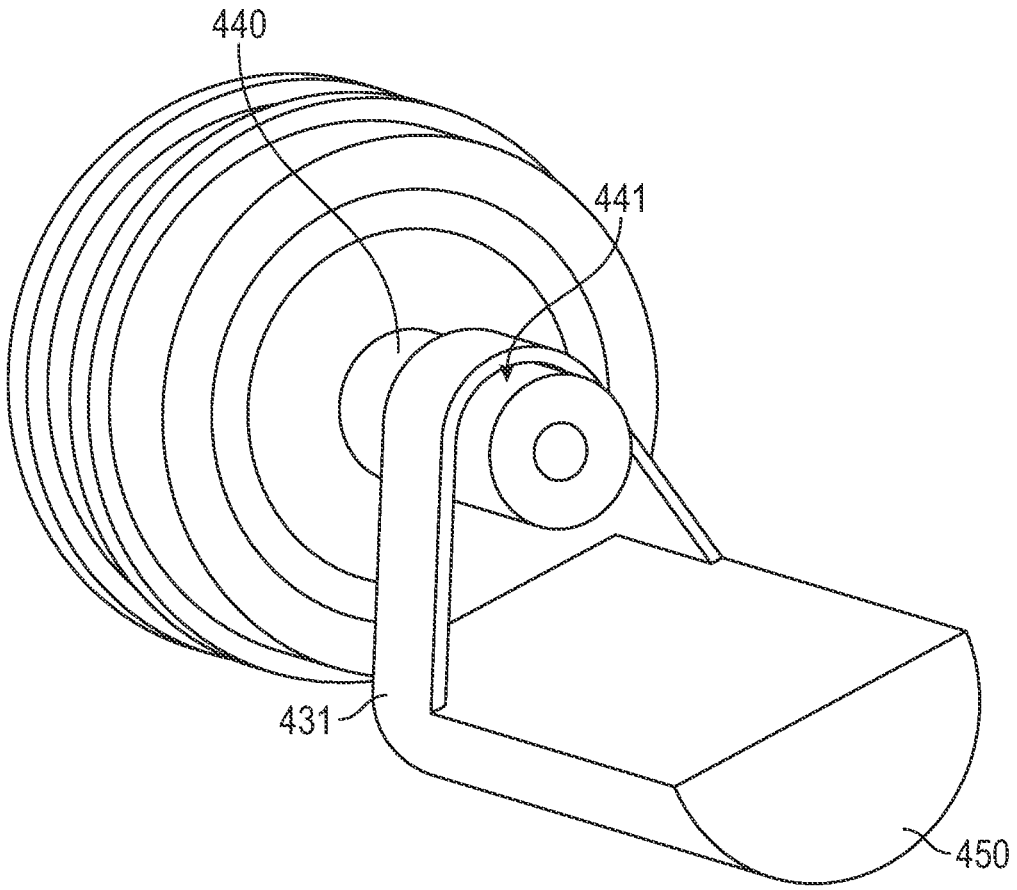
FIG. 14 is a simplified perspective view of the embodiment of the self-orienting perforating gun in FIG. 13.

The fourth embodiment is shown in FIGS. 13 and 14 where common elements are similarly numbered with the addition of another "100" except for the tandem sub 50. The rotating assembly 420 is shown without the outer housing 400 and is relatively similar to the third embodiment. The fourth embodiment does not include a roller bearing but rather the bearing assembly 430 comprises an outer race 431 that slides relative to the periphery or outer surface of the support hub 440 along an annular (e.g., cylindrical, frusto-conical), low friction slip interface or surface 441 defined by the periphery or outer surface of support hub 440. This low friction slip surface 441 may include rather high polished machining on the respective surfaces or using a low friction grease or other material or both. And, like the third embodiment, the eccentric weight 450 is directly connected to the outer race 431 of the bearing assembly 430. The outer race 431 comprises a flat, band-like or strap-like element that rides on a peripheral surface of the support hub 440 which serves as the inner race. With the eccentric weight connected directly to a low friction bearing assembly 430 with adequate eccentric weight would provide rotational flexibility and orienting torque to cause the rotating assembly to self-orient at least generally within a range of the desired orientation. This arrangement has the advantage of being relatively simple and low cost.

Figure 15:
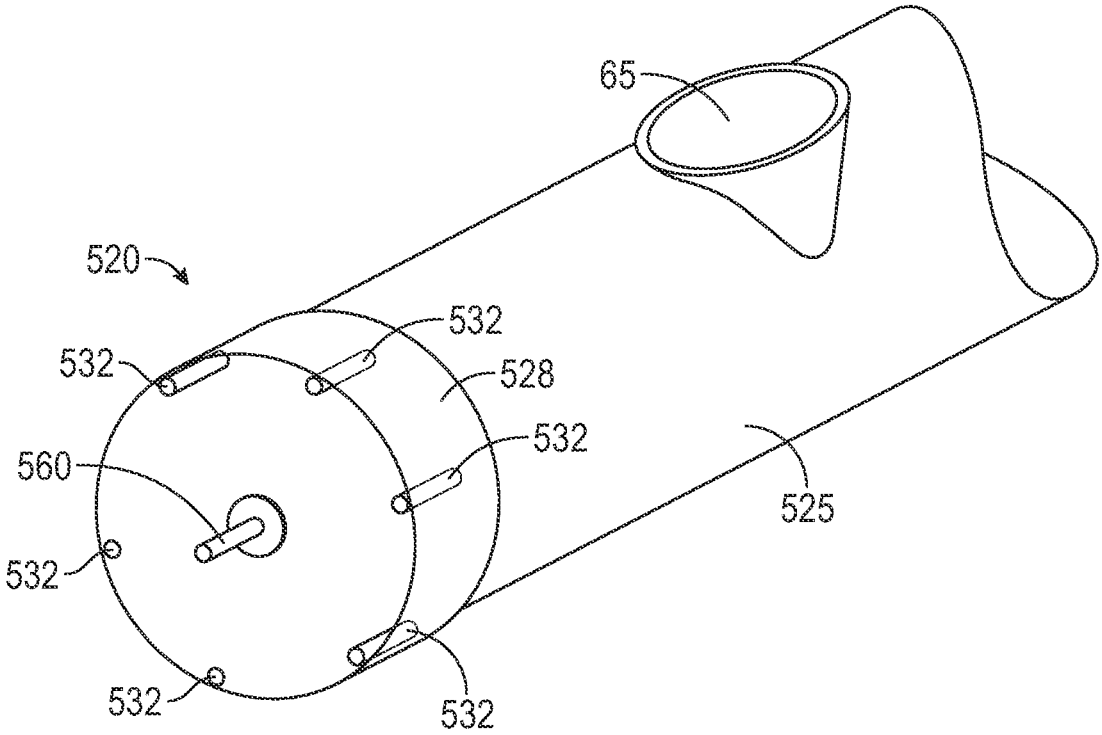
FIG. 15 is a fragmentary perspective view of another embodiment of the self-orienting perforating gun.
Figure 16:
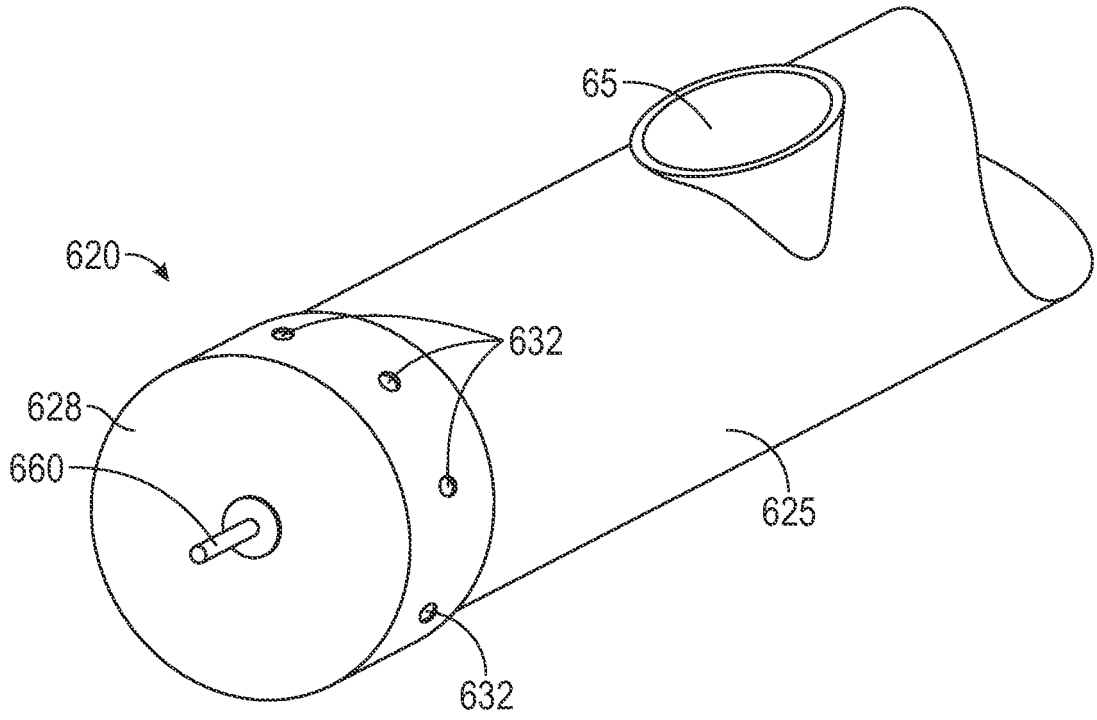
FIG. 16 is a fragmentary perspective view of another embodiment of the self-orienting perforating gun.

The fifth and sixth embodiments is shown in FIGS. 15 and 16 which share some similar features. The fifth embodiment includes common elements that are similarly numbered with the addition of another "100" except for the tandem sub 50 and the sixth embodiment likewise includes common elements that are similarly numbered but with the addition of a further "100". Focusing first on the fifth embodiment in FIG. 15, the endplate 528 is shown to have a larger diameter than the charge carrier 525. Along the peripheral surface of the endplate 528 are roller elements 532 held in place in blind bores that allow the roller elements 532 to rotate within the blind bores but have a peripheral face stand proud from the peripheral surface of the endplate 528 and ride against an inside surface of the outer housing (not shown). The inside of the outer housing may be unfinished but may alternatively have a smoothed inside bore overlying the roller elements 532 or a machined ring secured inside the inner bore for smoother rotation of the rotating assembly with respect to the outer housing.

The sixth embodiment shown in FIG. 16 differs in that the roller elements 632 are more spherical to accommodate axial deviations or irregularities in the outer housing (not shown) and still allow rotation of the rotating assembly on an axis of rotation that may deviate somewhat from the natural axis of the outer housing. The roller elements 632 are arranged to be retained in the endplate 628 but have a portion of the roller elements stand proud of the peripheral surface of the endplate to have the roller element contact the inside of the outer housing so that the endplate does not drag on the inside of the outer housing but more freely rotates due to the roller elements 632. These rotating assemblies 520 and 620 would have weights to provide the orienting torque but may be mounted inside the charge carriers 525 and 625. And the bearing assembly can be seen to include the endplate as the radially inner race and the outer housing comprise the outer race.

Figure 17:
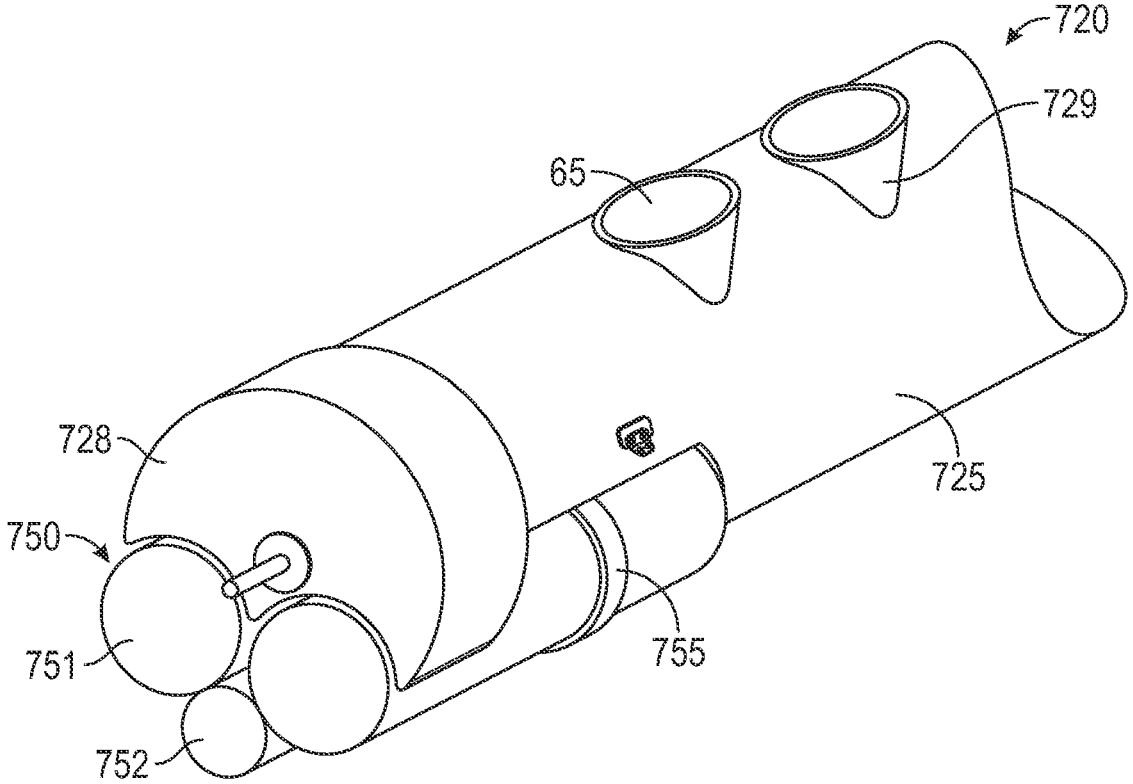
FIG. 17 is a fragmentary perspective view of an alternative weight carrying arrangement for the previously described embodiments of the self-orienting perforating gun.
Figure 18:
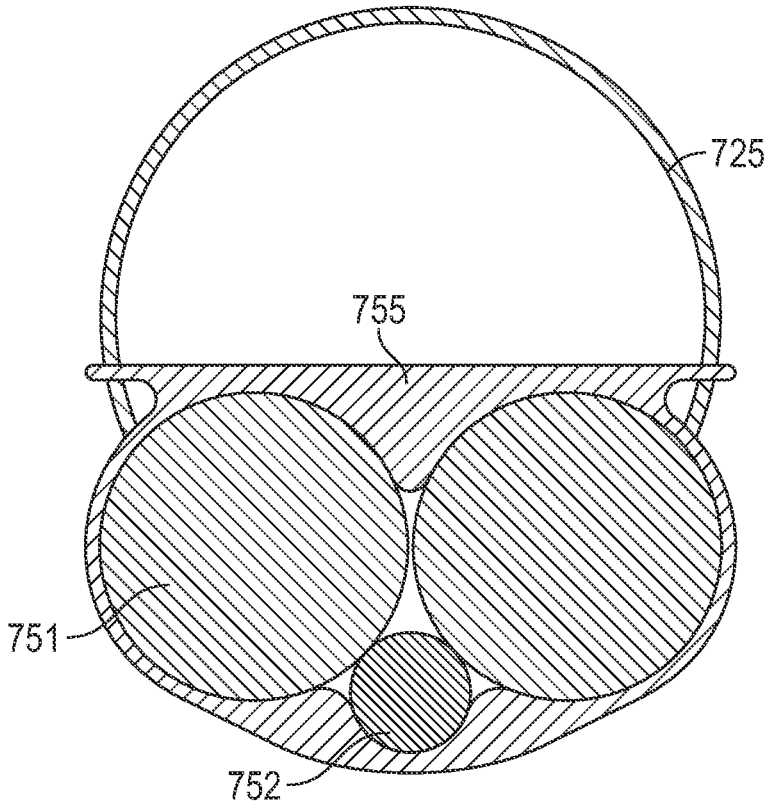
FIG. 18 is a cross-sectional end view of the alternative weight carrying arrangement shown in FIG. 17.

Turning now to an exemplary system for creating low-cost eccentric weight assembly 750 in the rotating assembly, an arrangement is shown in FIGS. 17 and 18 with standard profile steel bar stock cut to length and bundled to provide the off-axis weight needed to create an adequate orienting torque as desired. In at least some instances, round bar stock is the lowest cost raw material steel cost although round is useful but not required should exceptionally low-cost square, rectangular, hex, or other profile dense material be available. Other metals may also be used, but again, low cost and high density are desired. It also may be understood that the terms "bar stock" and "metal stock" as used herein encompass both original bar or metal stock (e.g., blanks, slugs, billets, and the like formed of raw purified metal used to manufacture metal parts) that has been cut to a desired length, as well as weights cast to imitate bar or metal stock (e.g., a weight cast in the shape of one or more integral pieces of bar or metal stock).

In the instant embodiment, the rotating assembly 720 includes multiple segments of bar stock such as large diameter round bar stock 751 (also referred to as large diameter weight bar 751) and small diameter round bar stock 752 (also referred to as small diameter weight bar 752) nested in the cleft between two large diameter stock pieces. One or more weight harnesses 755 hold the pieces of bar stock together in the preferred arrangement which may include a contour to better fit the bar stock segments. Depending on the selected length of the bar stock, more than two harnesses may be employed. Also, the harnesses may comprise multiple elements such as an inside contour designed for the shape of the bar stock and a common band or strap around the bottom of the bar stock holding the pieces to the inside contour. See the shape of the endplate 728 with rounded segments cut out to fit the large diameter bar stock in place. One point to emphasize in this FIG. 17 is the charge receptacle 729. Charge receptacles are in use in all of the embodiments of this disclosure which are sized and shaped cutouts in the charge carrier to snugly fit and secure a explosive charge 65 therein.

It may be understood that before any eccentric weight is added to the rotating assembly, the various components thereof contribute to the overall weight or mass of the rotating assembly where the center of that mass is unlikely to be very near the axis of the charge carrier. It has been observed that explosive charges 65 comprise a significant portion of the mass of the pre-eccentric weight of the rotating assembly and, tend to be heaviest at the muzzle (radially outwards) end. For a vertically downward preferred shooting orientation, the explosive charges 65 would be helpful. However, for any other angle, that off-center mass must be overcome. Shooting vertically upwards is particularly challenging. However, with sufficient mass in the eccentric weight, the resulting center of mass can be arranged as desired and needed.

Figure 19:
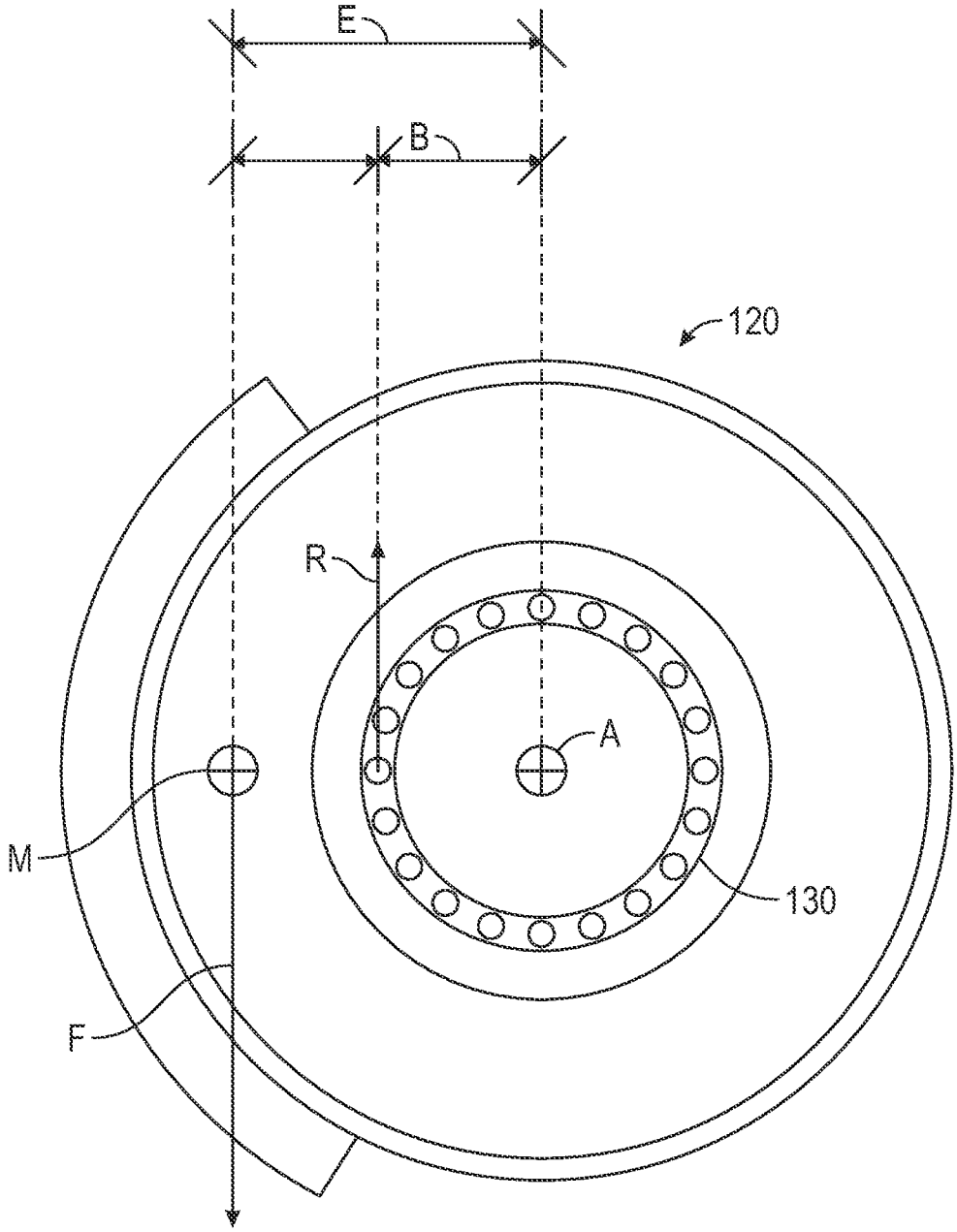
FIG. 19 is a cross-sectional end view of several of the embodiments of the self-orienting perforating gun illustrating the strongest imposed orienting torque created by the eccentric weight and resisted by the roller bearing.

As an exemplar for explanatory purposes, the center of mass (M) is shown in FIG. 19 and indicated by a small circle with darkened quarters at the top left and lower right. In the arrangement shown in FIG. 19, the gravitational pull on the mass of rotational assembly would tend to create an orienting force (F) with respect to the axis of rotation (A) as shown at the center of the bearing assembly. The bearing assembly 130, while designed to have minimal friction would still resist rotation with a force (R). With the center of mass of the rotational assembly 120 being at the maximum horizontal distance from the axis of rotation R, the orienting force F creates maximum orienting torque for re-orienting the rotational assembly 120 due to the long moment arm E. Due to the small diameter of the bearing assembly of the present disclosure, the impact or effect of frictional resistance imposed by the bearing assembly will be low. Thus, as long as the product of M and E (M×E) is greater than R×B, the rotating assembly will roll toward the desired angle. Note that (B) for consideration of the present disclosure is considered and shown as the distance from axis A to the center of the balls or roller element of the bearing, or the slip surface or plane of a bearing without balls or roller element. In some embodiments, bearing assemblies having a plurality of balls or other roller elements define a slip volume having a radial thickness corresponding to the respective diameter of the roller elements. The annular slip volume may define an annular radially inner slip interface or surface positioned along a radially inner periphery thereof and an annular radially outer slip interface or surface positioned along a radially outer periphery thereof. And it is also noted that frictional resistance to rotation is higher when the rotational assembly 120 is not rotating, but less when it happens to be rotating suggests that if the rotational assembly can be bumped or nudged into rotating, it will likely turn itself relatively close to the desired angle. In some embodiments, the bearings disclosed herein (e.g., bearing assembly 130 and others) have a diameter measured from one edge of the slip plane to an opposite edge of the slip plane that is less than 40 millimeters (mm). In some embodiments, the diameter of the bearing is less than 35 mm. In certain embodiments, the diameter of the bearing is at least 15 mm and less than 30 mm.

Figure 20:
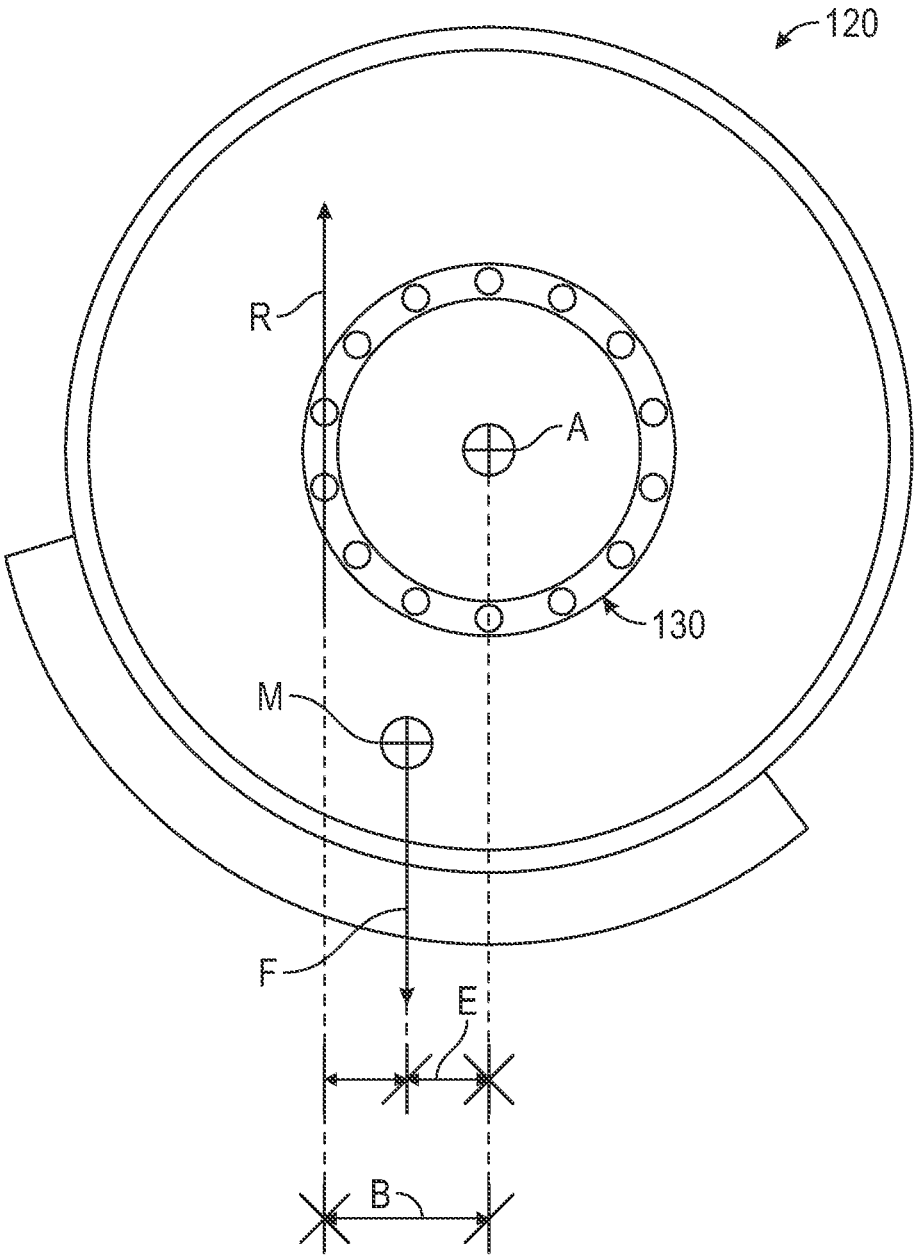
FIG. 20 is a cross-sectional end view of several of the embodiments of the self-orienting perforating gun illustrating an orienting torque created by the eccentric weight and resisted by the roller bearing.

Turning to FIG. 20 where the center of mas M has a much smaller moment arm E (horizontal distance from the center of mass M to the axis of rotation) the resistance to rotation may become higher than the effective orienting torque with the center of mass being slightly off center. Design considerations for achieving closer to desired orientation would include a larger mass for the rotational assembly, a more eccentric center of mass M resulting is a larger moment arm E, a lower friction bearing assembly and a smaller diameter bearing assembly resulting in a smaller moment arm B. Basically, the magnitude of the self-orienting torque varies depending on the degree of angular misalignment between the center of mass and the direction of gravity resulting in variations in length of the moment arm thereby altering the orienting torque driving the rotational assembly back toward the preferred orientation. Focusing specifically on reducing the resistance to the orienting torque, providing the smallest practical bearing assembly size would provide an advantage. While perforation guns vary quite a bit in diameter, most guns are just over 3 inches in diameter and in the present disclosure, the bearing assembly of the present disclosure, as measured at the diameter from the equator of one ball or roller element to the equator of the opposite ball or roller element is less than 25 mm. Considering that a common charge carrier outer diameter is about 48 mm, the diameter of the bearing assembly of the present disclosure is barely more than half the diameter of the charge carrier. Considering that the inner race of the bearing assembly needs to be supported by either the rotational assembly or something associated with either the outer housing or the tandem sub and isolated two-way electrical conductivity needs to pass through or over the bearing assembly (in the axial direction of the perforating gun), the possibility for creating a design to robustly carry the full load of the rotational assembly and all of its parts and pieces at a smaller diameter is certainly quite limited. With the design of the present disclosure for a perforating gun at 3 inches in diameter, a bearing race in accordance with the present disclosure would be at least 15 mm.

Figure 21:
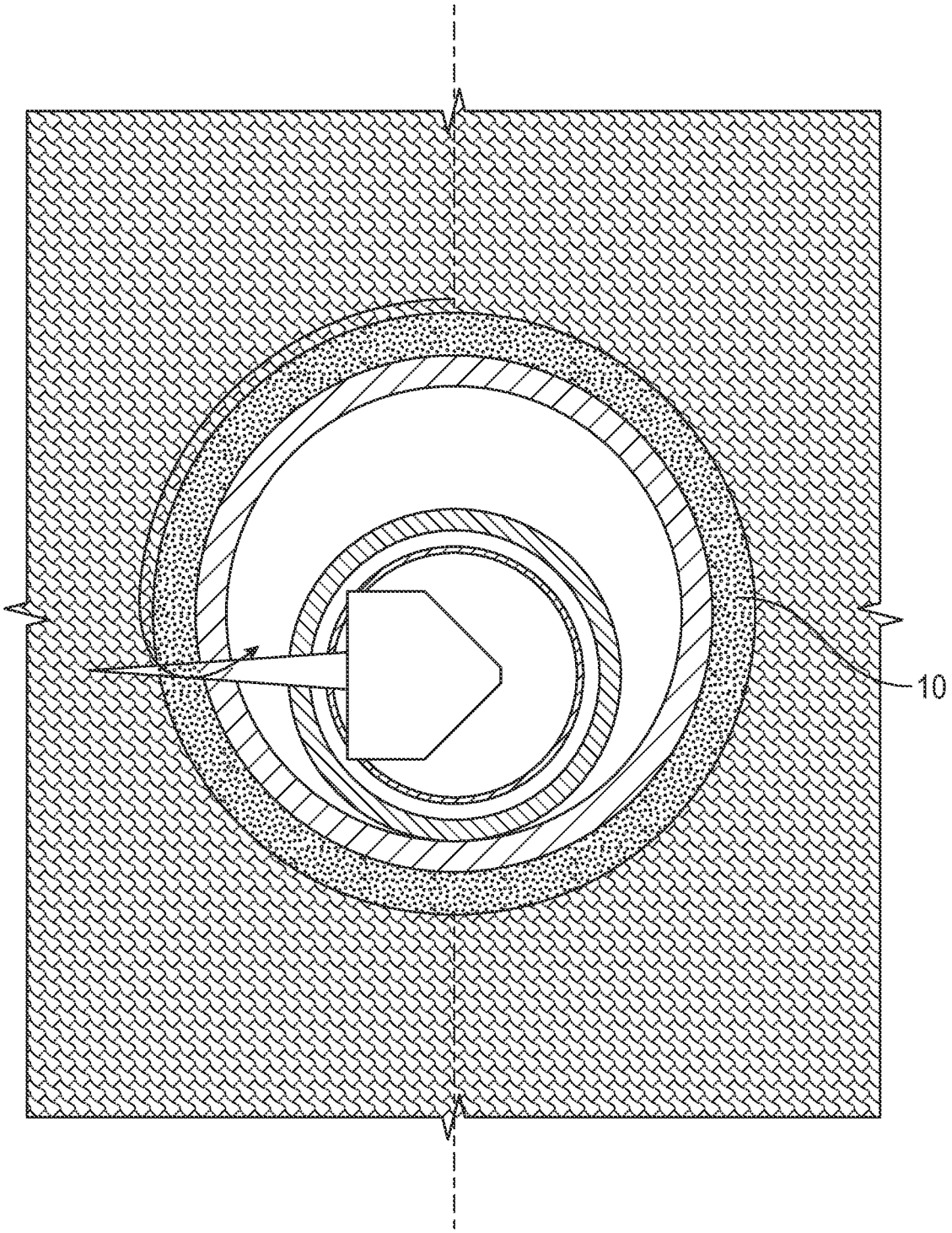
FIG. 21 is a cross-sectional end view of a non-self-orienting perforating gun illustrating a perforation shot out through the side of the casing when it would be more desirable have the perforations penetrate vertically.
Figure 22:
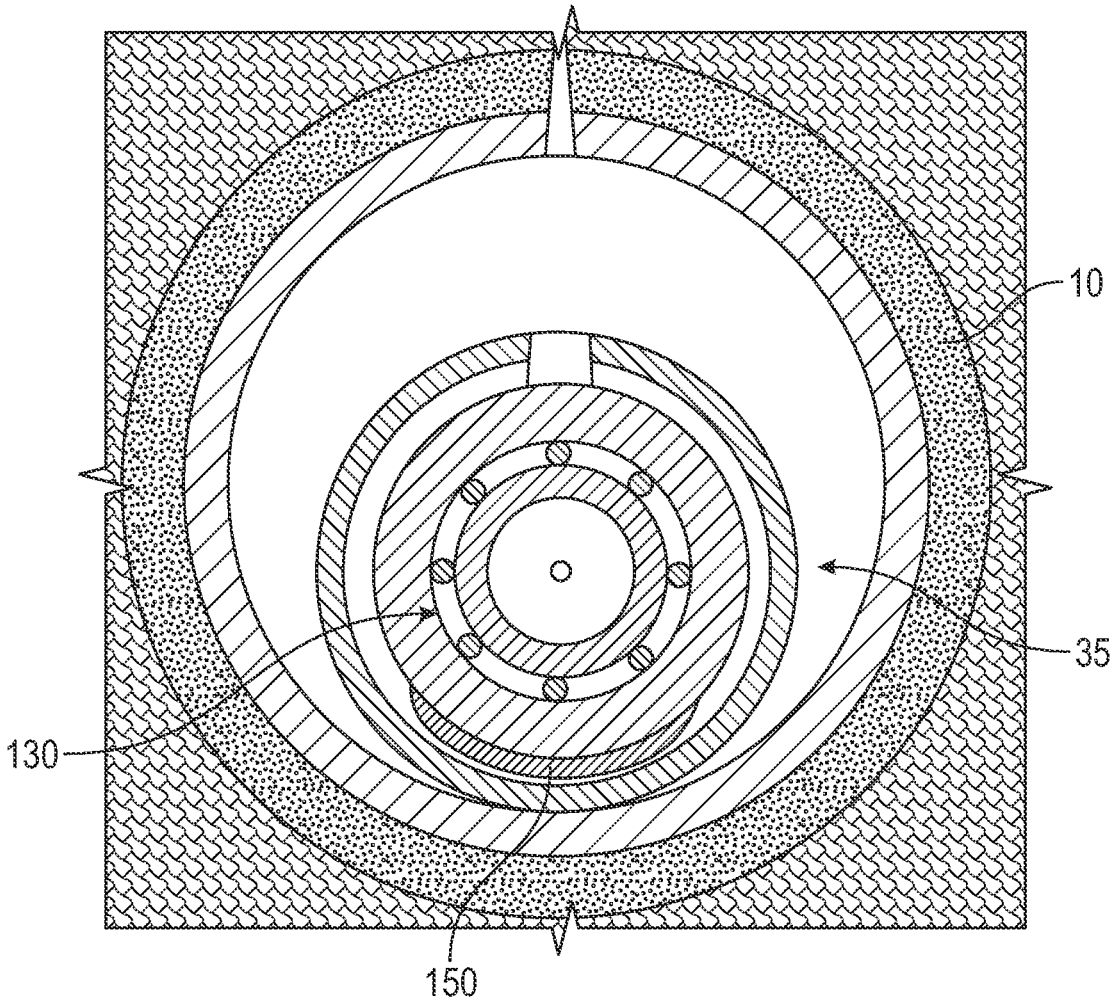
FIG. 22 is a cross-sectional end view with a self-orienting perforating gun arranged to shoot perforations out through the top of the casing as desirable.

Turning now to the impact of the present disclosure for the development of a hydrocarbon bearing well, FIG. 21 shows a cased wellbore 10 with a perforation that has been shot out the left side of the casing from a perforating gun that does not include the self-orienting features of the present disclosure. In this case, the operator believes that the well would be most productive if the perforations were created at the top of the horizontal run whether the wellbore is low in the hydrocarbon bearing formation, there is some kind of gravity drainage plan or the orientation of existing fractures in the formation make the opening up of the formation more effective with upwardly oriented perforations, FIG. 22 shows an upwardly oriented perforation shot from a self-orienting bearing gun where the eccentric weight 150 has been pulled by gravity and the bearing assembly 130 has permitted the rotating assembly to turn so that the charge receptacle and thereby, the explosive charges 65 to be aimed upward.

The charge carrier 125 is shown to be tubular in these exemplary embodiments, but it may of course assume other shapes, structures and configurations including a truss-like structure.

The endplate 128 in the various embodiments typically include a central passage or throughbore for the gun electric contact assembly to pass. In the first two embodiments, the bearing assembly 130 attaches directly to the endface of endplate 128 with the smallest practical diameter of the bearing assembly. The rotational assembly 120 includes charge carrier 125, endplate 128, the radially outer race 131 and eccentric weight 150 and this all rotates in concert about the rotational axis A. As described above, electric contact assembly 160 electrically connects the rotating assembly 120 of perforating gun 35 with the tandem sub 110. The support hub 140 physically supports the rotating assembly 120. The advantage with this load path is any frictional resistance to orienting torque is minimized. Additionally, the perforating gun 35 and particularly the outer housing 100, is put in bending when the tool string 30 is picked up from surface and raised into the position shown in FIG. 1. It also creates substantial bending as the gun string progresses from the vertical portion of the wellbore to the horizontal portion. This load path isolates the rotating assembly 120 from the outer housing 100 and avoids bending the bearings and other structure allowing free rotation of the charge carrier 125. This, along with the loose fit between the inner race and the support hub/plate hub, minimizes bending loads transmitted to the rotating assembly 120. As described above, the configuration of the eccentric weight 150 of the rotating assembly 120 may vary in other embodiments. For example, the eccentric weight may vary in size and shape, materials, and may comprise a single integrally formed component, or a plurality of separate, simpler and distinct components which are coupled or bundled together.

Recognizing that an electrical connection is typically best made along the axis of rotation and while that does impose some frictional resistance to rotation, the moment arm is quite minimal. But providing a small diameter bearing assembly 130 that rides on a hub that is just large enough to let the gun conductor pin through the hollow core thereof without short circuiting renders a design with a very small diameter bearing assembly. The diameter of the bearing of the present disclosure is clearly much less than the diameter of the charge carrier 125 and a small fraction of the outer diameter of the outer housing 100. For instance, it is expected that the diameter of the bearing assembly will be less than 60% of the outer diameter of the outer housing 100 and less than 80% of the outer diameter of the charge carrier 125. However, in some exemplary embodiments, the bearing assembly could be less than 50% of the outer diameter of the outer housing 100 and less than 60% of the outside diameter of the charge carrier 125. In even more exemplary embodiments, the bearing assembly is less than 25% of the outer diameter of the outer housing 100 and less than 50% of the outside diameter of the charge carrier 125. Note that all the disclosed embodiments have a small diameter bearing assembly except for the embodiments shown in FIGS. 15 and 16. FIGS. 15 and 16 may be low cost for manufacturing and simple to make and use, but the effective frictional forces will likely be less appealing than the other embodiments disclosed.

Figure 23:
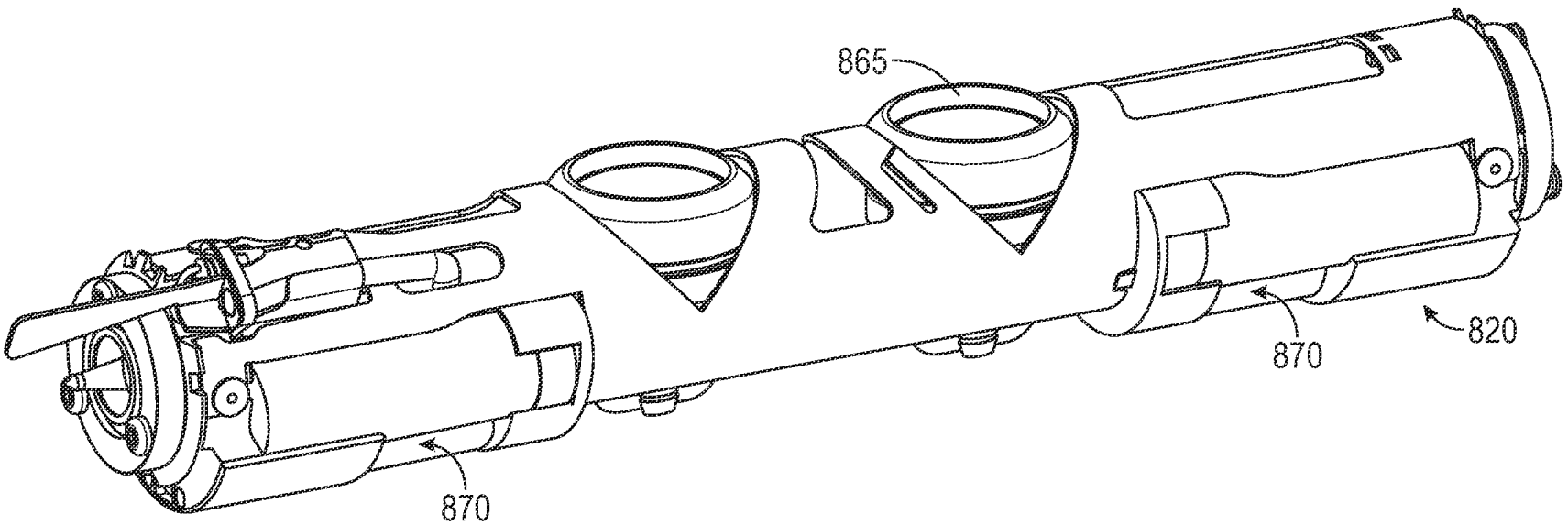
FIG. 23 is a perspective view of a fully assembled charge carrier assembly.
Figure 25:
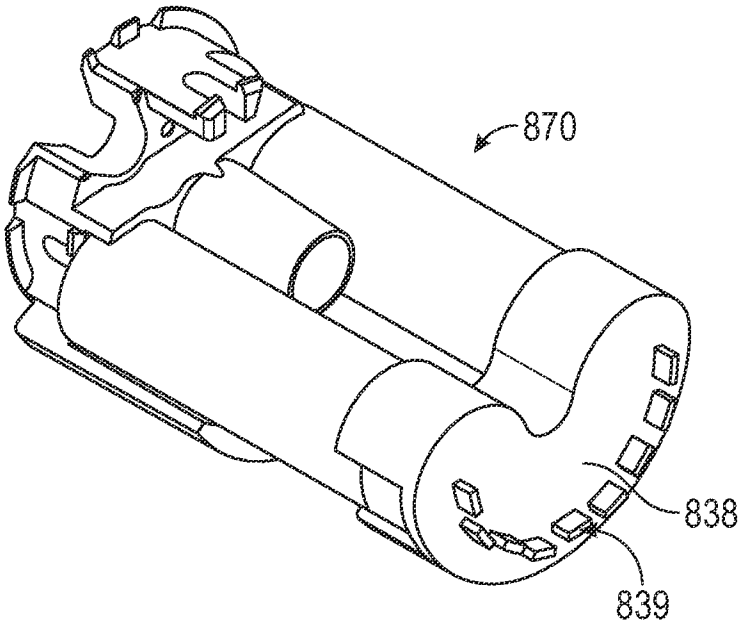
FIG. 25 is perspective view of an assembled weight pack.
Figure 24:
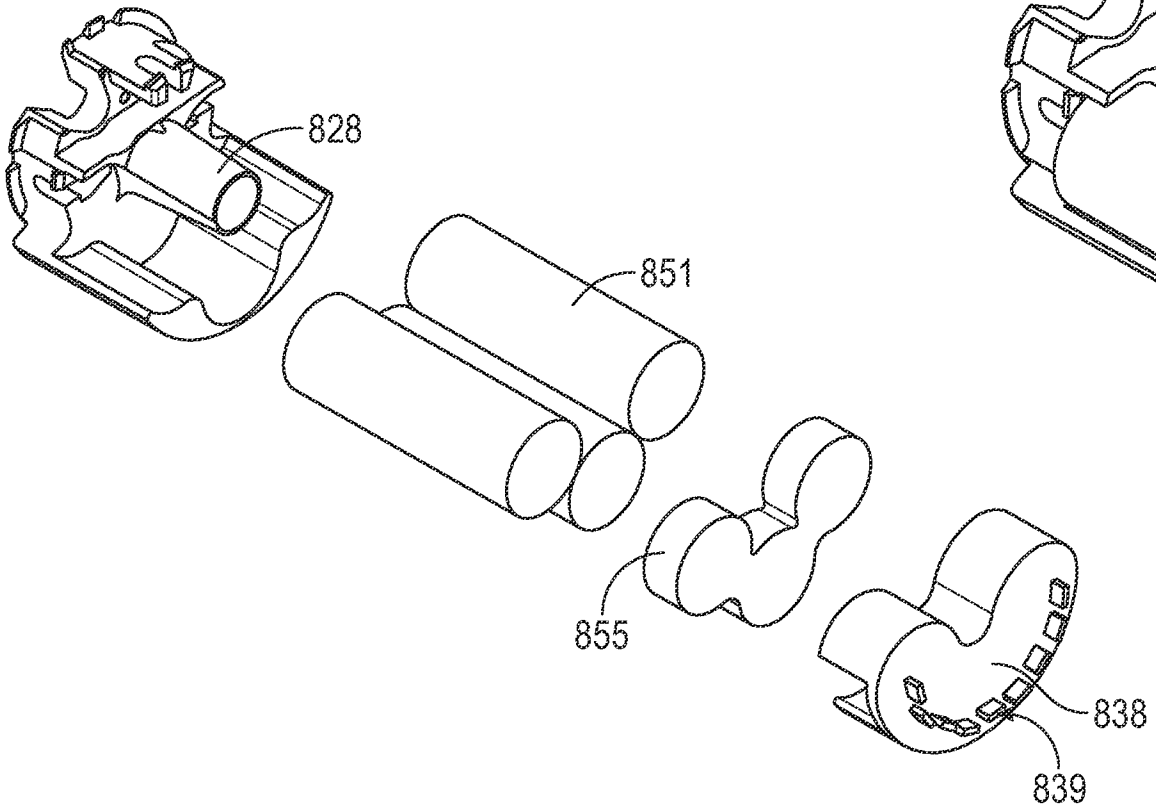
FIG. 24 is an exploded perspective view of a weight pack.

In the course of developing new technologies and new products, issues and opportunities arise, and solutions and improvements are created. The development of a self-orienting perf gun has given rise to many opportunities to improve the design and reduce costs for manufacturing such new self-orienting guns. Turning now to FIG. 23, a further embodiment of the present disclosure is shown as a substantially fully assembled rotating assembly 820 ready for installation into a generally tubular outer housing (not shown). One aspect of this embodiment is that the eccentric weights (e.g., eccentrically mounted weight bars) thereof continue to comprise standard bar stock (for low cost), but the eccentric weights of rotating assembly 820 are more modularized in the form of a weight pack 870 positioned on either side of shaped explosive charges 865 near the ends of the rotating assembly 820. Referring to FIGS. 23-25, a given weight pack 870 of rotating assembly 820 is better seen in FIGS. 24 and 25 where segments 851 of bar stock are carried within the generally closed ends of an endplate 828 and a weight cap 838 of the rotating assembly 820. In this exemplary embodiment, the weight pack 870 includes a blast plate 861 positioned at the ends of the bar stock segments 851 closest to the explosive charges 865 to better insulate and protect the bar stock from deformation or other damage so that the bar stock may be easily re-used in a future self-orienting perf gun. It should be seen that in this exemplary embodiment the free or outside end of the weight cap 838 includes a series of alignment tabs or castellations 839 preferably arrayed in two corresponding arcs.

The end plate 828 and the weight cap 838 are designed and manufactured to fit snugly around the rounded ends of the bar stock as to nest with and cradle the plurality of bar stock segments 851). Additionally, while three bar stock segments 851 are shown in FIGS. 23-25, it may be understood that varying number of bar stock segments 851 (including a single bar stock segment 851) may be accommodated. Typically, the end plate 828 and the weight cap 838 are slipped over the ends of the segments 851 in an axial orientation or direction such that once the ends of the bar stock segments 851 down into each of the end plate 828 and the weight cap 838, the bar stock segments 851 are securely held in place and neither the end plate 828 nor the weight cap 838 may be twisted off the bar stock segments 851. The depth of the internal recess defined by weight cap 838 includes depth to accommodate the thickness of a blast plate 855 of the rotating assembly 820 and capture a sufficient length of the bar stock segments 851 to fully secure the segments 851.

Figure 27:
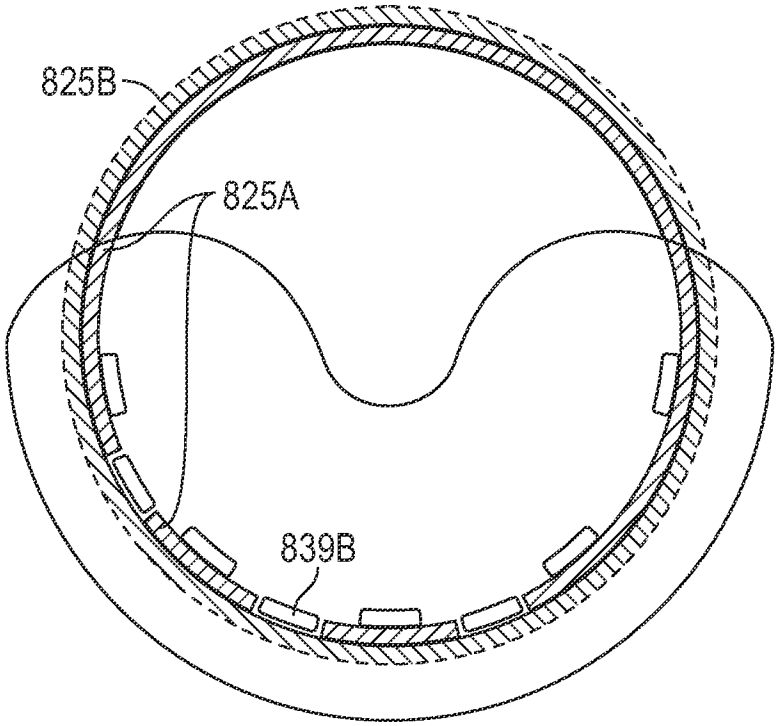
FIG. 27 is an end view similar to FIG. 26 but actually showing the two differently sized charge carriers abutted up against the position tabs.
Figure 26:
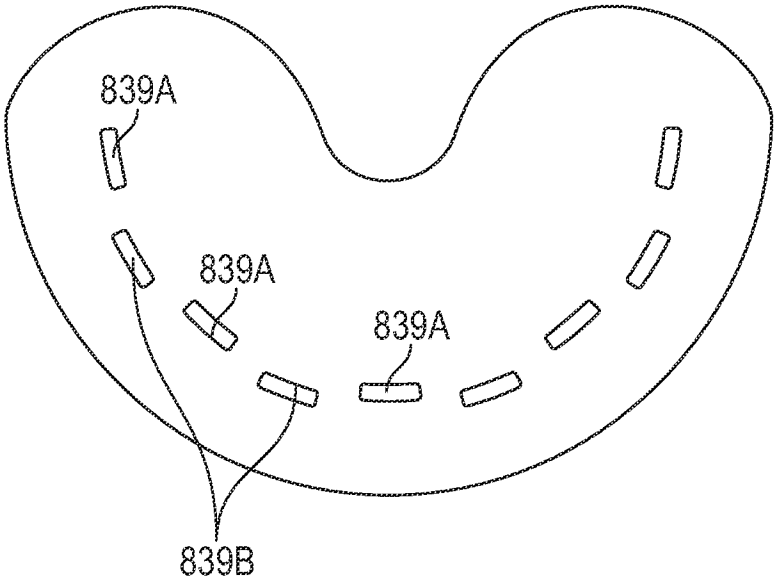
FIG. 26 is an end view of a weight cap with two rows of alignment tabs arranged in two concentric arcs for positioning the weight cap and thereby the weight bars relative to the axis of the charge carrier.

Turning to FIGS. 26 and 27, the two concentric arcs of alignment tabs 839 (indicated as alignment tabs 839A and 839B in FIGS. 24 and 25 for clarity) permit a single weight cap design to be used for each of the two weight packs 870 per self-orienting perf gun. The size of alignment tabs 839A and 839B may vary depending on the given size or diameter of the self-orienting perf gun comprising alignment tabs 839A and 839B. The respective arcs are only slightly different in their diameter to accommodate both the smaller standard 1⅞ inch tubular charge carrier typically used in a 3⅛ inch gun, and the slightly larger 2 inch tubular charge carrier typically used in standard 3⅜ inch guns. It may be understood that FIG. 27 illustrates an embodiment having a large diameter 2-inch charge carrier 825B that does not have cut outs 827.

Figure 29:
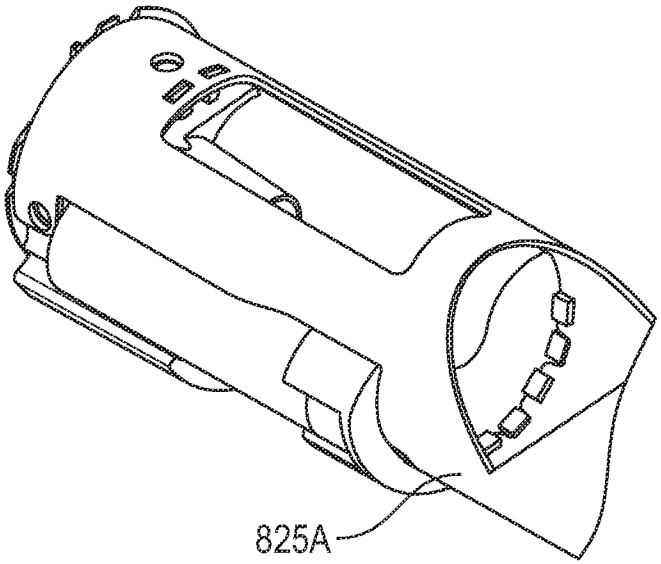
FIG. 29 is a fragmentary perspective view of the additional embodiment charge carrier with a weight pack positioned in place.
Figure 28:
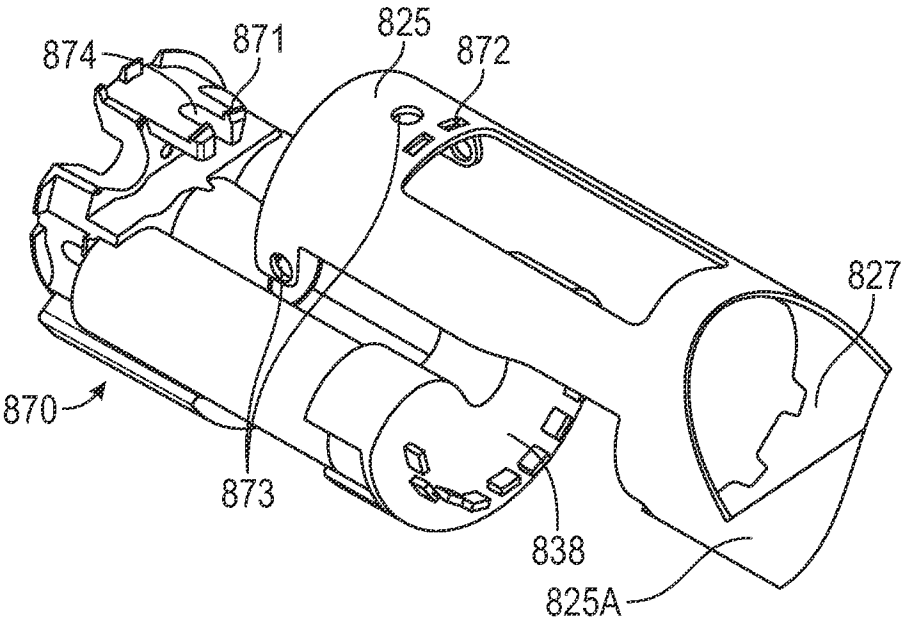
FIG. 28 is an exploded perspective and partially fragmentary view of a weight pack being installed into an additional charge carrier embodiment.

Turning to FIGS. 28 and 29, a tubular charge carrier 825 is shown having a configuration where an upper portion (roughly an upper half where the charge carrier is viewed has having a horizontal axis) extending further to the ends in a cantilevered configuration. In this exemplary embodiment, the lower half of the charge carrier 825 is cut away to accommodate the weight pack 870. Additionally, the weight pack 870 is attached to a charge carrier 825 by inserting the alignment tabs 839 of the weight cap 838 into the inside diameter of the charge carrier 825 at its lower half such that the alignment tabs extend up inside the inner diameter of the charge carrier 825 while the blunt cut end of the lower half of the charge carrier 825 bluntly presses (or resists movement of) the weight cap 838 against the ends of the bar stock segments 851. It should be noted that with the slightly smaller diameter charge carrier shown in FIGS. 28 and 29, there are cut outs 827 in the lower half of the charge carrier 825 arranged to step over the alignment tabs 839B in the larger arc. The weight cap 838 is then supported by the charge carrier 825 via the alignment tabs 839.

With the alignment tabs 839 inserted into the interior of the charge carrier 825, the opposite end of the weight pack 870 is lifted up to the top cantilevered end of the charge carrier 825 for axial restriction tabs 871 of the weight pack 870 to settle into slots 872. Screws or, more preferably, rivets may hold the charge carrier 825 to the end plate 828 at holes 873 aligned with grooves 874. The axial restriction tabs 871 are bottomed into the slots 872 preventing the weight pack 870 from moving axially and keeping the segments 851 of the weight bars bottomed into both the end plate 828 and the weight cap 838. Connecting the hole 873 to a groove 874 formed in the end plate 828 rather than a hole may seem counterintuitive, but this allows a mold to be prepared such that the end plate 828 with a groove may be cast complete in one single casting operation. Substituting a hole for groove 874 extending through the end plate 828 in a radial direction presents a closed feature that would need to be formed in a subsequent step following the casting step. As such, a hole would add additional manufacturing costs that are saved by eliminating a hole in favor of a groove 874. The axial restriction tabs 871 provide the restriction that a hole would have provided, but the axial restriction tabs 871 may be formed in that single casting step as will be explained below.

The weight pack 870 is held in place in this exemplary embodiment by the associated shape of the weight pack 870 and the cantilevered cut charge carrier 825 such that the weight pack 870 may not move axially within the rotating assembly 820 but the blunt end of the weight cap 838 against the blunt end of the lower half of the charge carrier 825 cannot fall from the charge carrier 825 because of the alignment tabs 839B, cannot lift upwards toward the axis by the long edge of the cantilevered section of the charge carrier 825, and cannot pull out from the end of the charge carrier by the rivets and the axial restriction tabs 871 in the slots 872.

Figure 31:
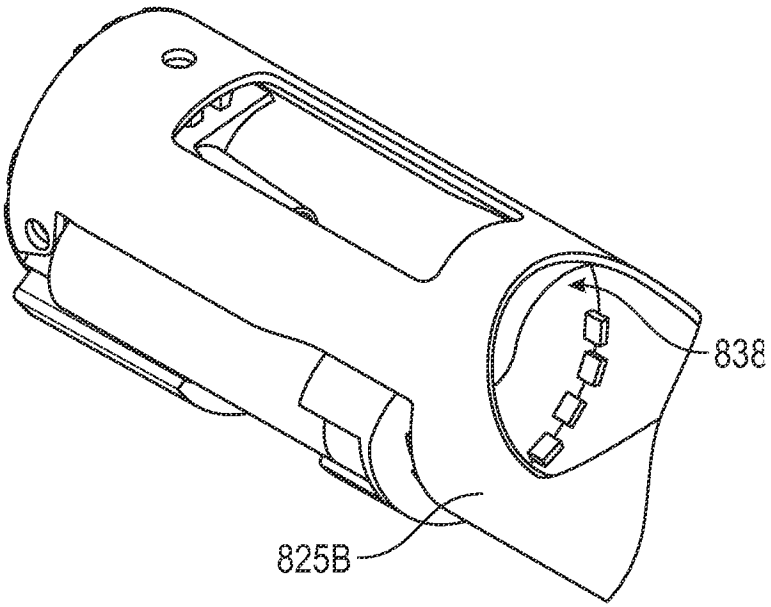
FIG. 31 is a fragmentary perspective view of the second additional embodiment of the larger diameter charge carrier with a weight pack positioned in place.
Figure 30:
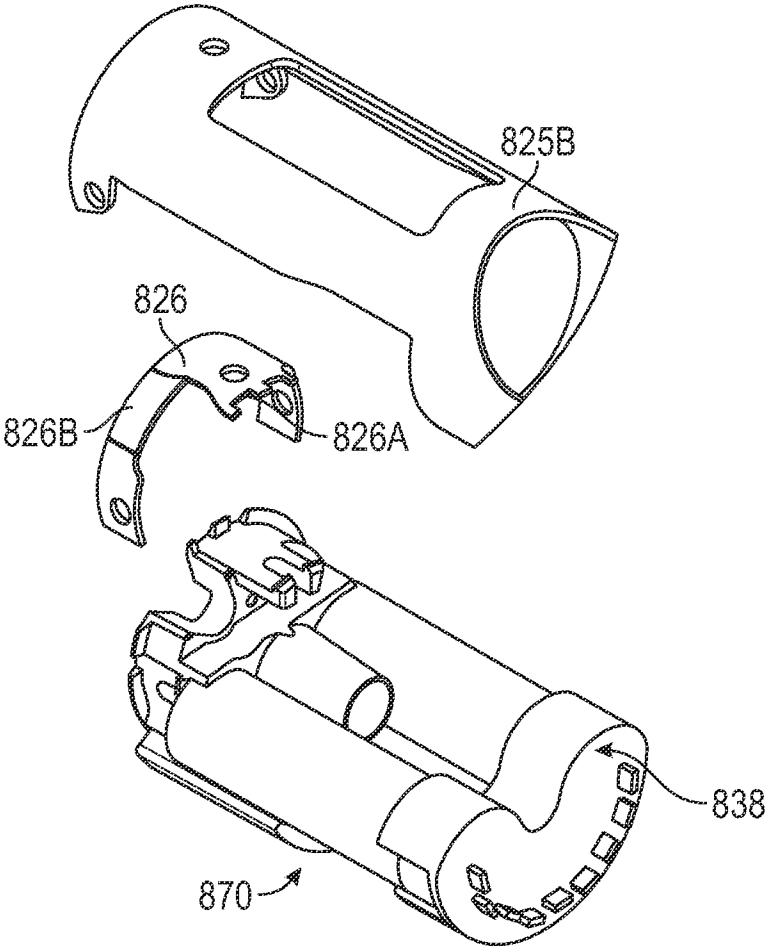
FIG. 30 is an exploded partially fragmentary view of a second additional embodiment of a charge carrier having a slightly larger diameter showing the same sized weight pack being installed therein.

Turning to FIGS. 30 and 31, an embodiment is shown in which the larger diameter charge carrier 825B carries the weight pack 870 by the larger arc of alignment tabs 839B and a shim 826. In this exemplary embodiment, the axial restriction tabs 871 connect to notches 826A of the shim 826 while rivets or other fasteners extend through holes in the charge carrier 825B, the shim 826 and the grooves 874 in the end plate 828. Additionally, a knockout 826B is shown in the shim 826 for the end of the rotating assembly 820 that carries the det block 875 as will be explained later. The weight packs 870 are used at both ends of the charge carrier 825, but, in this exemplary embodiment, the charge carrier is not symmetrical end-for-end as it is configured for a det block 875 at one end and not the other.

Figure 33:
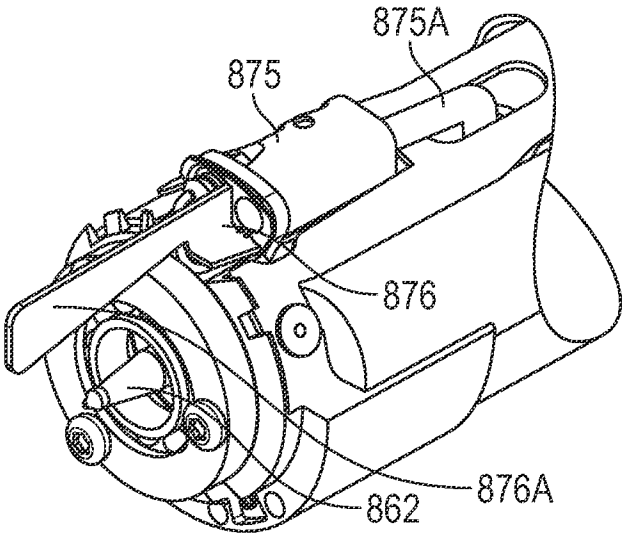
FIG. 33 is a perspective fragmentary end view similar to FIG. 32 showing the interrupter installed into the det block which also has det cord installed connecting the det block to the explosive charges.
Figure 32:
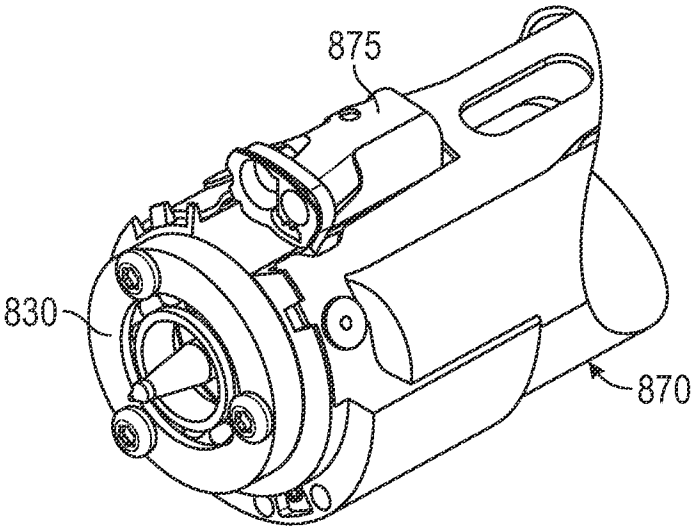
FIG. 32 is a perspective fragmentary end view of a more fully assembled charge carrier assembly specifically showing the bearing assembly face mounted to the end of the endplate and the det block attached to the charge carrier.

Turning now to FIGS. 32 and 33, an embodiment is shown in which the end plate 828 is shown with the bearing assembly 830 bolted on to the end face thereof with gun conductor pin 862 (also referred to herein as electrical pin connector 862 or simply electrical connector 862) projecting out from within the inner race of the bearing assembly 830. On the outside of the charge carrier 825 is a det block 875 used to transform an electrical signal to a physical detonation of detonation cord 875A. In this exemplary embodiment, an interrupter 876 is positioned in the det block 875 (as shown in FIG. 33) to physically separate the electrical detonator and the detonation cord 875A to prevent an un-intended detonation of a loaded self-orienting perf gun. A pull tab 876A of the interrupter 876 projects well away from the det block 875 such that the rotating assembly cannot be closed inside the outer housing (not shown). Additionally, the charge carrier is configured with a cutout for the det block 875, but for the larger diameter charge carrier 825B, the shim 826 would have the knockout 826B removed at the perforated score line to make room for installation of the det block 875 and the associated assembly of wiring and other components.

Figure 34:
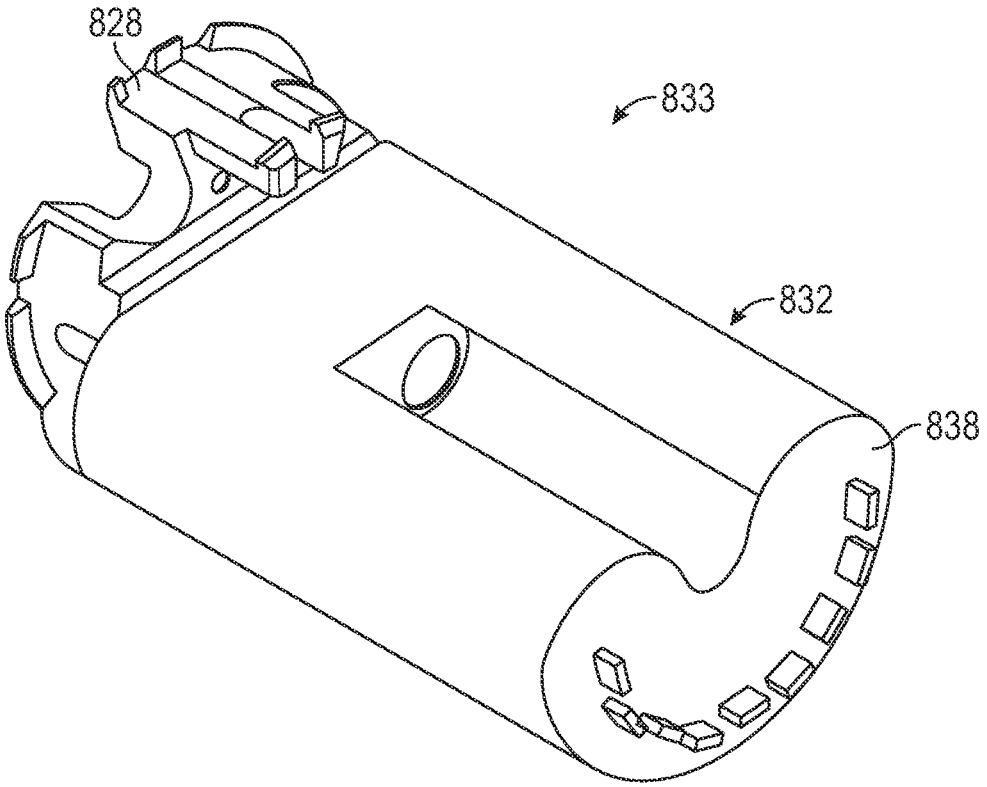
FIG. 34 is a perspective view of an embodiment of a weight assembly.

Turning briefly to FIG. 34, an embodiment is shown in which the end plate 828 and weight cap 838 are formed integrally with a weight pack 832 as one integrally or monolithically formed weight assembly 833.

Figure 35:
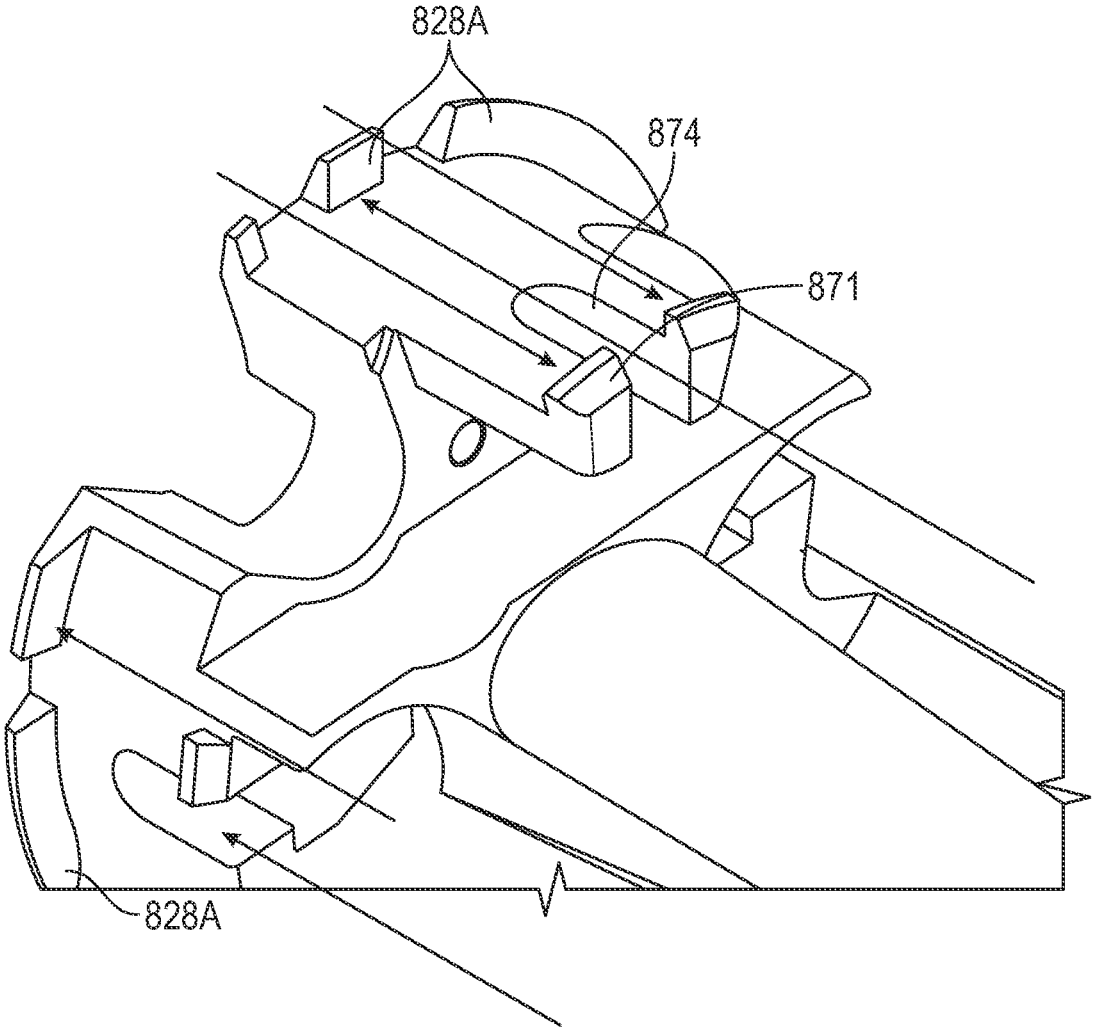
FIG. 35 is a fragmentary perspective view of an endplate to show the direction of draw for manufacturing a complete and ready to install endplate from a two-part mold.
Figure 37:
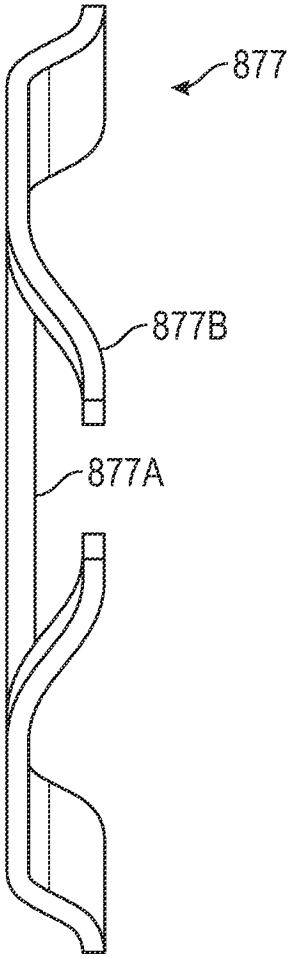
FIG. 37 is a side view of a ground spring for providing a secure and continuous ground electrical current path between a tandem sub and the rotating assembly.
Figure 36:
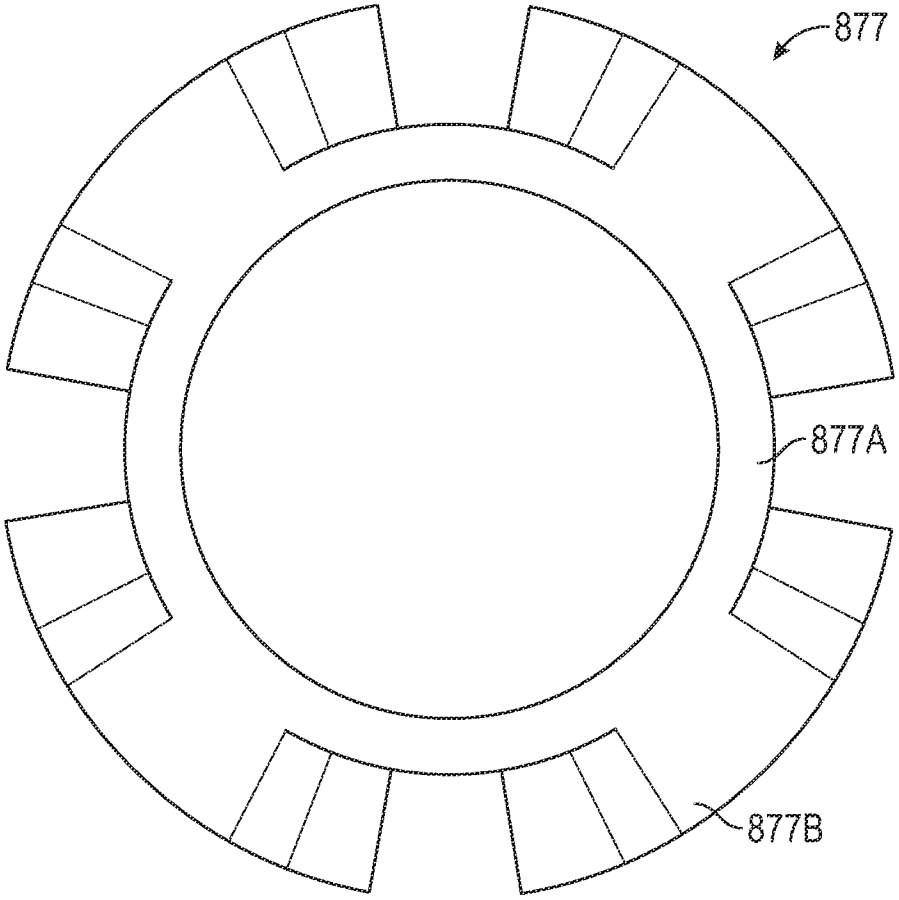
FIG. 36 is a top view of a ground spring for providing a secure and continuous ground electrical current path between a tandem sub and the rotating assembly.

Turning now to FIG. 35, one aspect for producing this self-orienting perforating gun at a low cost is the efficient manufacture of its components. In this exemplary embodiment, the endplate 828 and the weight cap 838 may be cast from molten metal such as zinc in a two-part mold where the parts are pressed together, molten metal is delivered into the engineered cavity within the mold, the metal cools and hardens and the two-part mold is drawn apart to drop out a cast or molded component. For the component to be a finished component, typically all of the projections and recesses must be shaped by the mold that has to pull apart in a linear motion. Any feature such as a radial hole or indention cannot be easily closed within the component preventing the opening of the mold without resulting in additional undesired costs and complexity in forming of the mold. As mentioned earlier, forming the end plate 828 with a groove 874 avoids having a closed radial hole. As shown by the parallel arrows (illustrating the direction or angle of draw in this exemplary embodiment), the axial restriction tabs 871 and other shoulders and ridges, such as radial lips 828A which extend out in segments from the outer face of the end plate 828 for the abutment of the end of the charge carrier 825, have open access for the mold halves to pull apart after the molten metal has hardened. Subsequent drilling or milling to components adds undesired processing time and significant costs per part that is avoided by having a clear zero angle of draw for the components of a perforating gun.

In another aspect for making a better perf gun with a self-orienting feature is the need for a signal path and a ground path for electric communication to the bottom of a gun or tool string (comprising the perf gun) and back to the surface. Both paths need to be continuous and uninterrupted. A brief gap in either could have serious consequences for operating a gun string with dozens of guns where, for example, a gun may not receive its corresponding signal to fire and thus fail to fire. When the gun string is brought back to the surface, the unfired perf gun will have an armed and explosive device that is hazardous to personnel rather than a spent and inherently safe device. Continuous and uninterrupted electrical communications are thus very important.

Turning now to FIGS. 36-39, it has been found that a washer-shaped ground spring 877 provides a reliable ground path from the tandem sub 50 to the end plate 828 of the rotating assembly 820 through the inner race of the bearing assembly 830. It is noted that the inner race of the bearing assembly 830 will not rotate relative to the tandem sub 50 while the outer race will rotate relative to both. Within the race are a plurality of roller elements or balls where several such elements are always in contact with the outer race which is in continuous electrical communication with the end plate 828. In this exemplary embodiment, the ground spring 877 has a core ring 877A and several circumferentially spaced fingers 877B bent out of the plane to press against the inner race 831 (shown in FIG. 39) of the bearing assembly away from tandem sub 50. Thus, in addition to providing a reliable electric ground path that does not interfere with the rotation of the rotating assembly 820 within the outer housing (not shown), the ground spring 877 also urges the rotating assembly 820 into a central position between the tandem subs 50 at each end of the outer housing and further provides some buffering or shock absorption. The shock absorption function provided by ground spring 877 may be important considering the knocks a string of perf guns may endure being lifted off the ground and then banging around inside the wellbore in its vertical decent.

Figure 39:
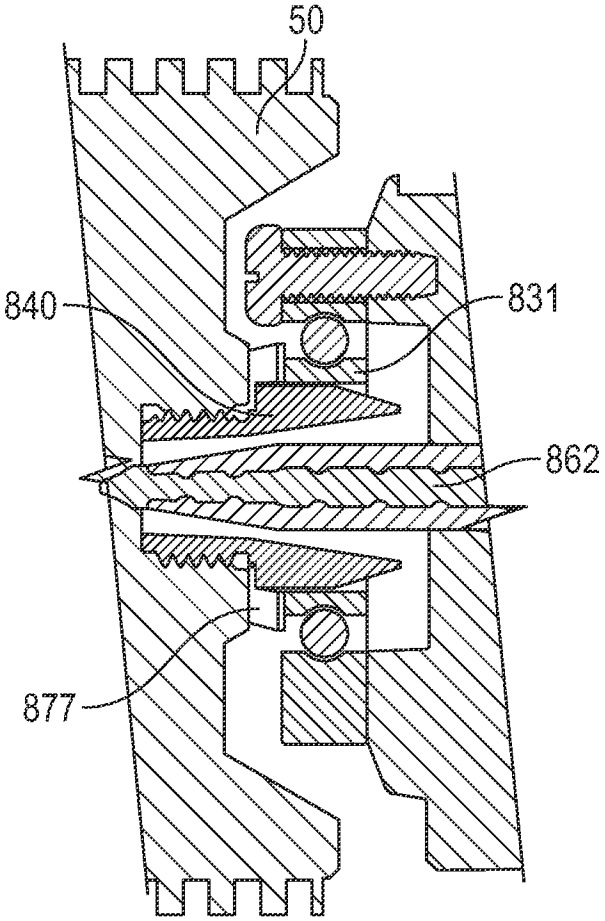
FIG. 39 is a fragmentary cross-sectional elevation view showing the ground spring pinched between the tandems sub and the support hub or support hub and also reaching out for continuous contact with the inner race of the bearing assembly.
Figure 38:
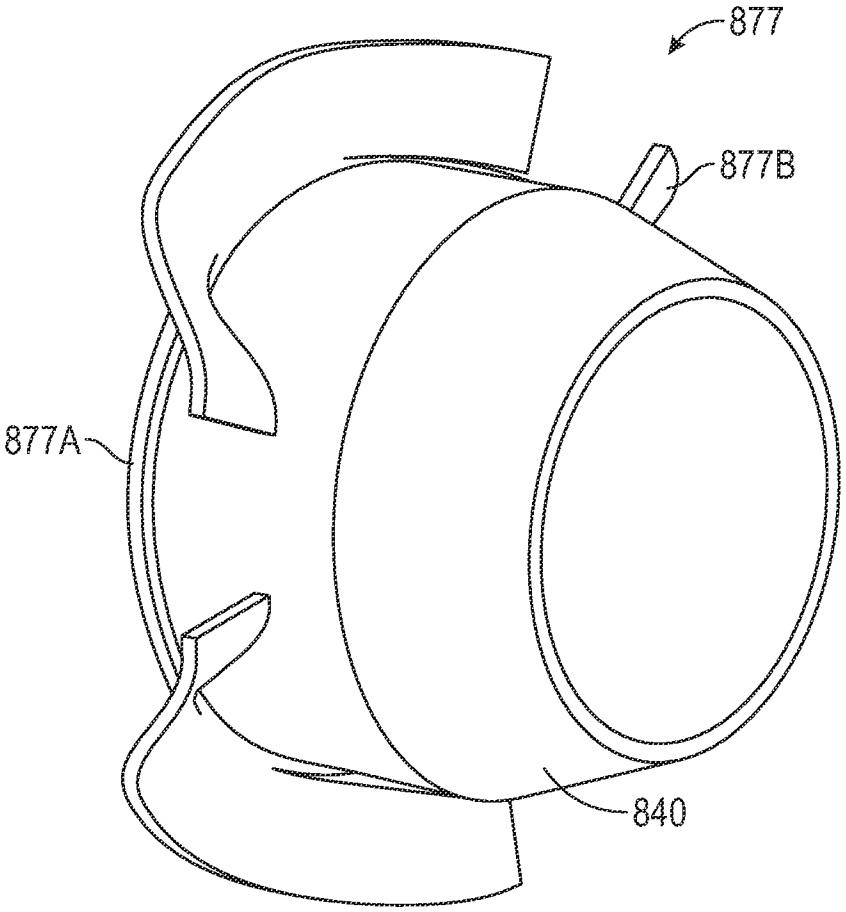
FIG. 38 is a perspective view of a support hub or support hub with the ground spring fingers arrayed around the hub reaching toward the inner race of the bearing assembly (not shown in this Figure)

The gun conductor pin 862 shown in FIG. 39 includes a frangible profile noted by the series of recurring thinned diameter sections which are designed to deform and break in the event a gun conductor pin 862 were to be dislodged from its location in the gun into a position that may cause any portion of the tool string to bind in the wellbore. It may be understood that having the tool string bind in the borehole is an undesired development and having a frangible design to reduce the risk of the conductor pin 862 binding in a way that the wireline system cannot withdraw the full tool string is believed to be an advantageous design. In some embodiments, gun conductor pin 862 has a predefined yield strength of approximately between 1,000 pound-force (lbf) and 200 lbf such as, for example, 750 lbf, 500 lbf, 350 lbf, 300 lbf, and 250 lbf. Additionally, in some embodiments gun conductor pin 862 may include an outer insulating body where a ratio of the axial length of the outer body to the axial length of inner conductive pin is approximately between 0.5:1 to 0.9:1; however, in other embodiments, the ratio of the axial lengths of the outer body and gun conductor pin 862 are acceptable. Further, in certain embodiments, gun conductor pin 862 may have a predefined yield strength that is based on a yield strength of the wireline used to convey the self-orienting perf gun through the wellbore. For example, in some embodiments, gun conductor pin 862 may have a predefined yield strength, and a working strength that may be approximately between 50% and 60% of the yield strength of the wireline to which the self-orienting perf gun comprising pin 862 is attached.

Figure 40:
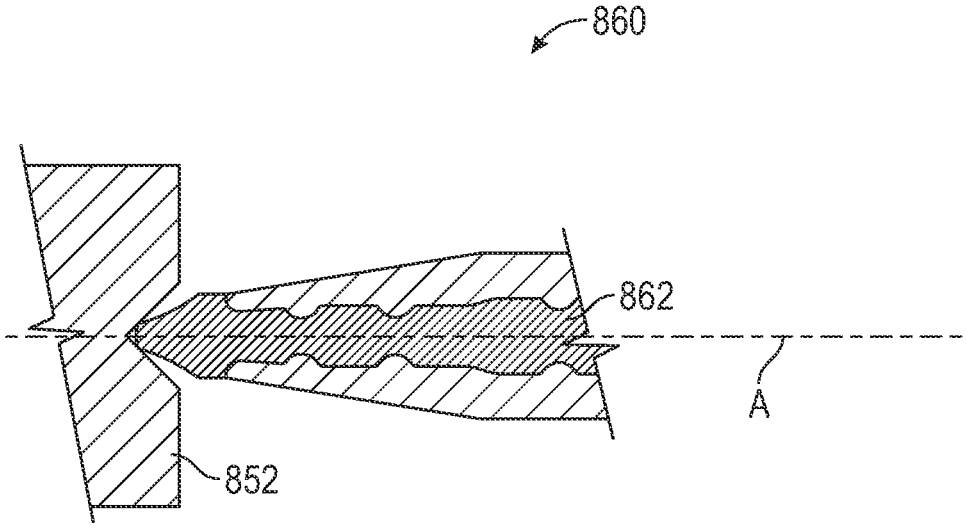
FIG. 40 is an enlarged fragmentary cross-sectional view of the pin connector and subbar showing the tight point on the end of the pin connector arranged to reduce rotational friction between the pin connector and subbar as the rotating assembly rotates within the gun carrier.

Turning to FIG. 40, the frangible gun conductor pin 862 is shown engaging with a subbar 852 (also referred to herein as bulkhead electrical connector 852). Although gun conductor pin 862 is shown as comprising a pin and bulkhead electrical connector 852 is shown as comprising a corresponding recess in this exemplary embodiment, it may be understood that in other embodiments connector 852 may comprise a pin and connector 862 may comprise a corresponding recess. In still other embodiments, connectors 852 and 862 may comprise corresponding flats which make electrical contact along a planar interface formed therebetween. Additionally, it may be understood that as the gun conductor pin 862 rotates relative to the subbar 852, which is held in the tandem sub 50 about an axis of rotation A, physical engagement of the two elements at locations away from the axis of rotation A resists such rotation. Even a contact diameter D1 of only about 0.10 inches will noticeably restrict the rotating assembly 820 from achieving a highly precise orientation settling (e.g., an orientation that is less than about 10 degrees from a desired, fully settled orientation). However, a diameter of contact between the gun conductor pin 862 and the subbar 852 that is less than about 0.08 inches generally provides reliable orientation settling of within plus or minus 3 degrees of a fully settled orientation. Thus, in some embodiments, the gun conductor pin 862 and subbar 852 are in physical contact with one another such that the physical contact extends no further from the axis of rotation A than 0.080 inches. In certain embodiments, the gun conductor pin 862 and subbar 852 are in physical contact with one another such that the physical contact extends no further from the axis of rotation A than 0.060 inches. In certain embodiments, the gun conductor pin 862 and subbar 852 are in physical contact with one another such that the physical contact extends no further from the axis of rotation A than 0.050 inches.

Figure 41:
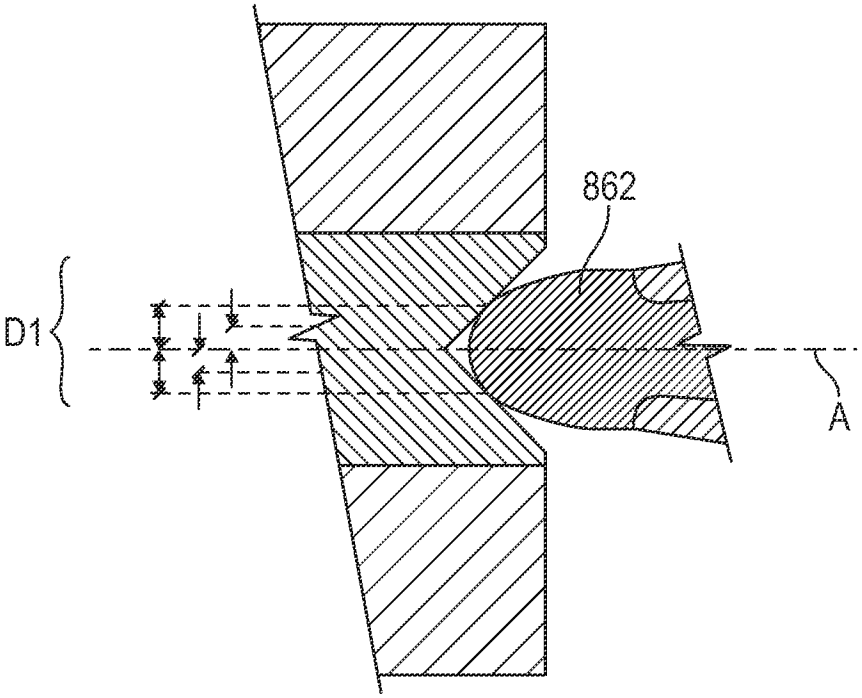
FIG. 41 is a further enlarged fragmentary cross-sectional view of the pin connector and subbar showing size of the pin connector in other embodiments of the present disclosure where the contact between the pin connector and the subbar has a conventional diameter.

Turning to FIG. 41, the original design of the end of the gun conductor pin 862 does not press entirely to the bottom of the corresponding conical recess to prevent dust or debris from interfering with the electrical connection formed therebetween in the event that any such dust or debris should enter the perforating gun. While a perfectly fine or sharp pencil point might be optimal for precise orienting, such a perfectly fine point risks signal loss if non-conductive dust or other debris of even a very small size should become trapped in the conical recess formed between the gun conductor pin 862 and subbar 852.

Figure 42:
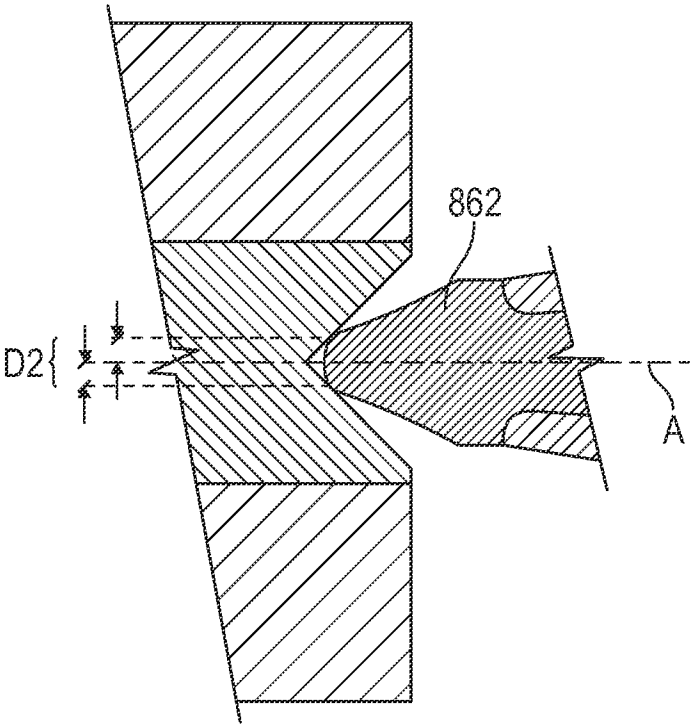
FIG. 42 is similar to FIG. 41 showing the configuration and size of the pin connector with a much tighter point on the end of the gun conductor pin arranged to reduce rotational friction between the pin connector and subbar as the rotating assembly rotates within the gun carrier.

Turning to FIG. 42, an embodiment is shown in which a contact diameter D2 has been reduced to less than 0.060 inches; however, it may be understood that contact diameter D2 may be less than 0.060 inches in some embodiments. For example, in some embodiments, contact diameter D2 is about 0.055 inches or less. In some embodiments, contact diameter D2 is about 0.050 inches or less. In certain embodiments, contact diameter D2 is about 0.045 inches or less. In certain embodiments, contact diameter D2 is about 0.040 inches or less. The reduced contact diameter D2 helps fully minimize the remaining rotational friction to allow a rotating element that has its eccentric weight pack 870 nearly vertically below the axis of rotation to achieve a highly precise gravitationally driven settling orientation of less than plus or minus 2 degrees. It may also be noted that in some embodiments the end of gun conductor pin 862 is chamfered about its perimeter leading to a bulbous tip at the terminal end thereof such that as the rotating assembly 820 departs from the settling orientation as the gun string is handled the point of contact between the bulbous tipped gun conductor pin 862 and the corresponding subbar 852 remains substantially stationary and does not move around from the tip of the pin at the axis A. Additionally, the more severe angle formed between the terminal end of the gun conductor pin 862 and the heavily sloped sides thereof will generally scrape away or remove any dust or other debris from the slopes of the conical recess of subbar 852, thereby assuring a continuous, unimpeded electrical connection between the subbar 852 and the gun conductor pin 862.

Figure 43:
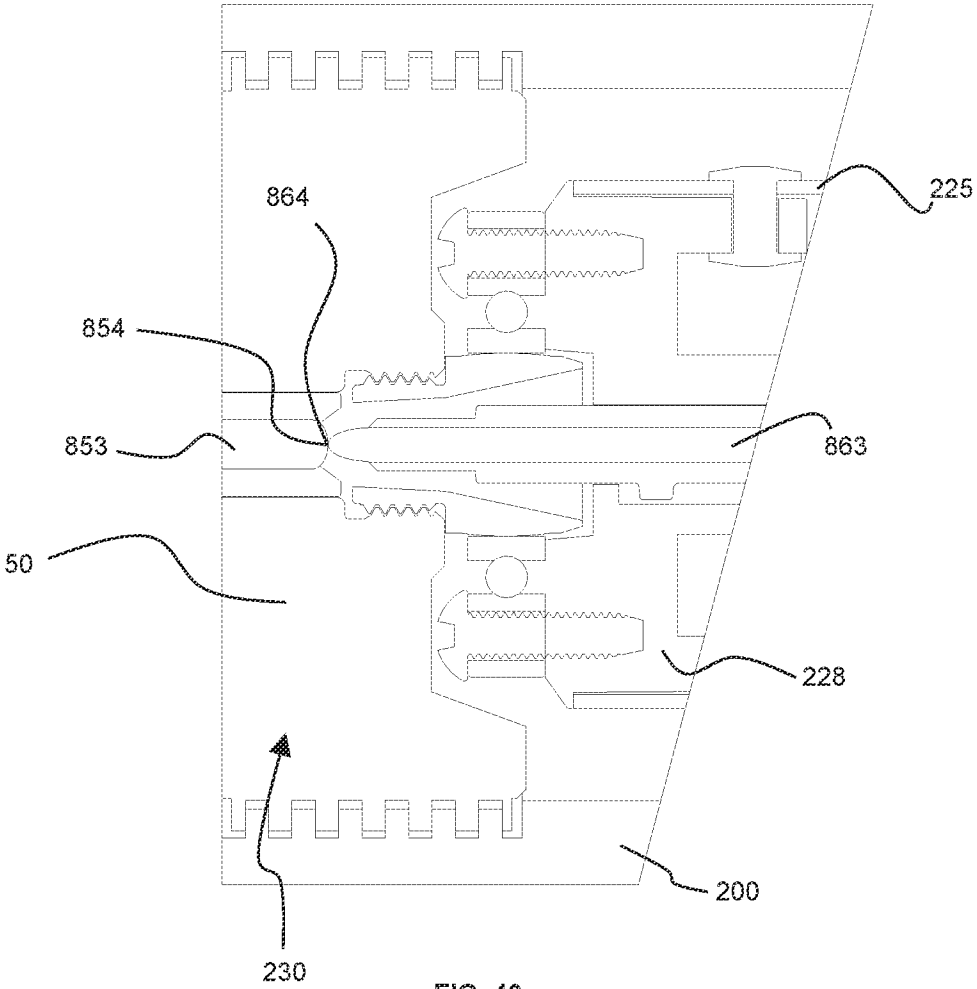
FIG. 43 is an enlarged fragmentary cross-sectional view of another embodiment of a subbar and a pin connector forming a point contact interface.

Turning to FIG. 43, an embodiment is shown including a subbar 853 defining a convex terminal end or contact surface 854 and a corresponding gun conductor pin 863 similarly defining a corresponding convex terminal end or contact surface 864. Contact surfaces 854 and 864 of subbar 853 and gun conductor pin 863, respectively, may physically contact to establish an electrical connection between subbar 853 and gun conductor pin 863. Particularly, surfaces 854 and 864 are configured to establish an electrical connection across a convex-on-convex or point contact interface between surfaces 854 and 864. The contact diameter (e.g., diameter D2) of the point contact established between surfaces 854 and 864 of subbar 853 and gun conductor pin 863, respectively, may be less than 0.040 inches to minimize torsional resistance (e.g., negligible torsional resistance) to relative rotation between subbar 853 and gun conductor pin 863.

Figure 44:
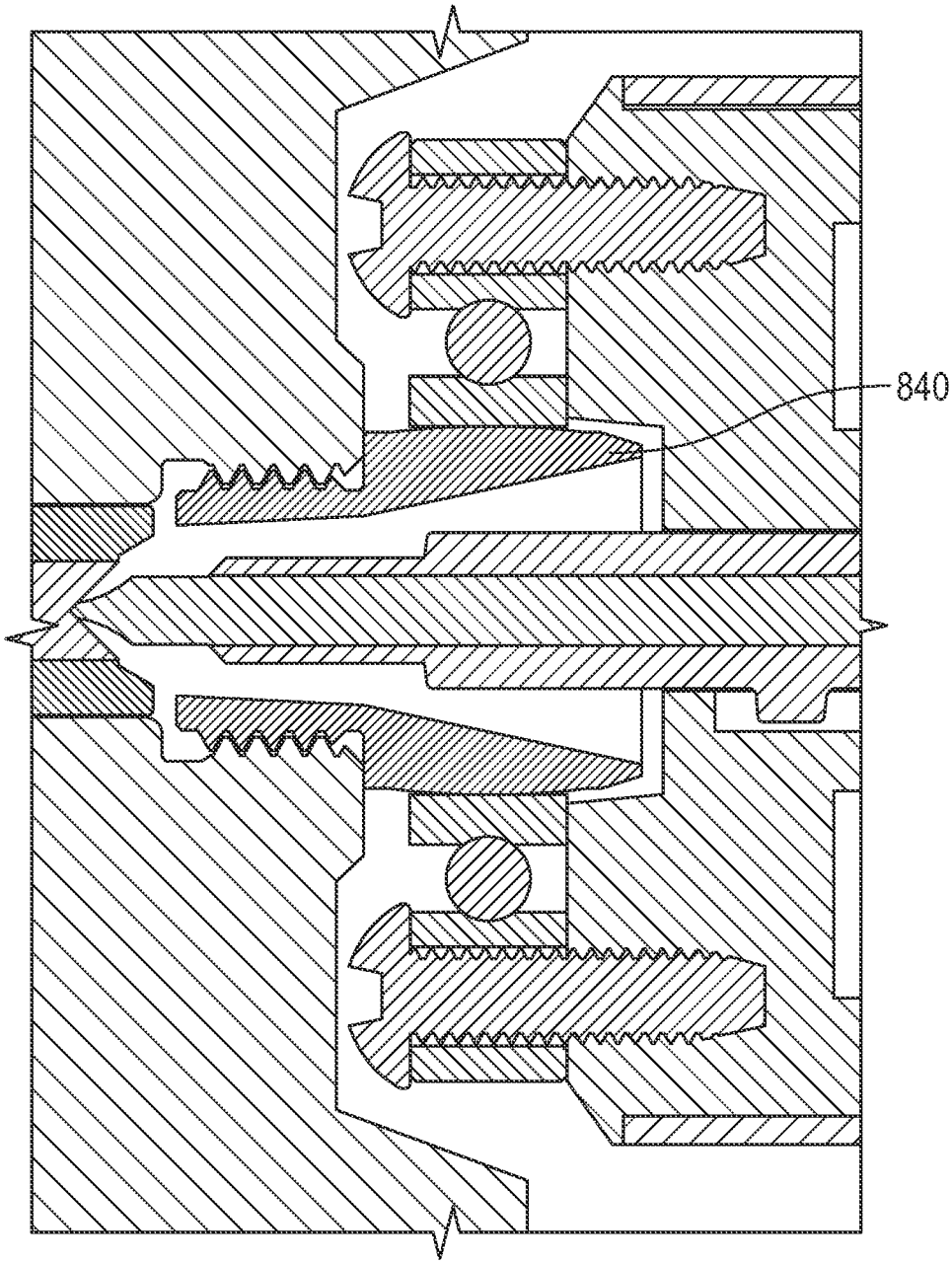
FIG. 44 is an enlarged, fragmentary cross-sectional view of a different embodiment of the present disclosure where the support hub or support hub has a spherical shape on the outer surface for contacting and supporting the inner race of the bearing assembly where any differential bending of the rotating assembly and tandem sub or gun carrier won't bind the bearing assembly or other aspects of the perforating gun to resist any impairment of the self-orienting function of the inventive perforating gun.
Figure 45:
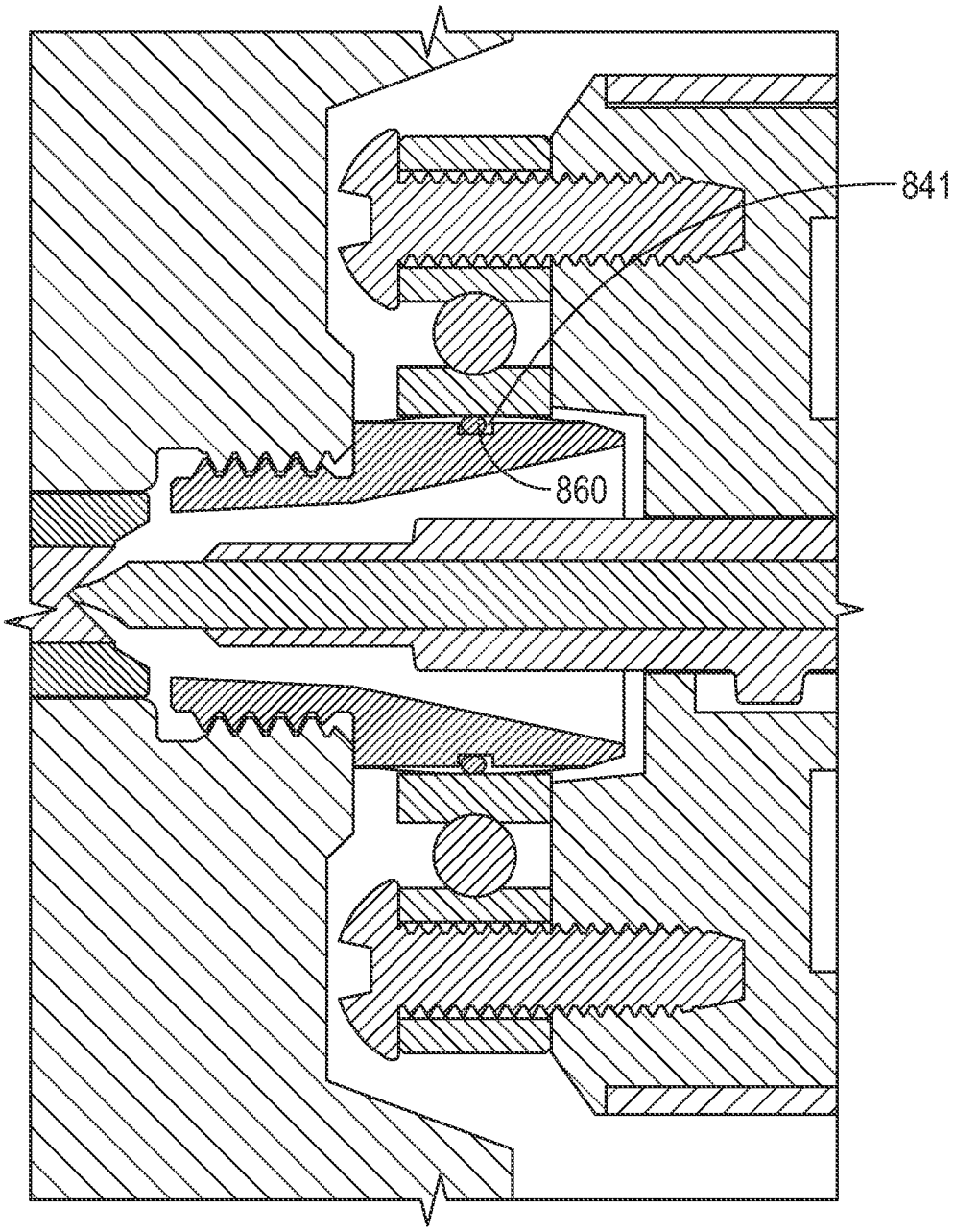
FIG. 45 is an enlarged, fragmentary cross-sectional view compared to FIG. 44 but showing a further alternative embodiment of the present disclosure where the support hub or support hub has an O-ring groove and an O-ring to provide bending flexibility of the rotating assembly relative to the tandem sub and also provide natural centering of the inner race of the bearing assembly and even some tolerance for shocks naturally imposed on perf guns.

Turning now to FIGS. 44 and 45, while substantial bending is not expected between the rotating assembly 820 and the tandem sub 50, some degree of bending is expected and several designs to accommodate such bending are shown in FIGS. 44 and 45. Particularly, FIG. 44 illustrates an embodiment in which the outside surface of the support sub 840 has been altered from a generally cylindrical configuration to a generally spherical configuration permitting the inner race of the bearing assembly 830 to shift without binding the bearing assembly 830 or deflecting or deforming the bearing assembly 830. Additionally, FIG. 45 illustrates an embodiment in which an O-ring channel 841 is formed on the generally cylindrical wall of support sub 840 and an oversized O-ring 860 is received therein to provide some elastomeric flexibility between the support sub 840 and the radially inner race. Additionally, a rounded and further minimized axial contact surface between the O-ring 860 and the radially inner race is provided by this embodiment as compared to the radially inner race against a cylindrical outer wall extending for the axial length of the radially inner race. The elastomeric nature of the O-ring may also be expected to provide shock absorbing qualities, effectively increasing the durability of the embodiment of the self-orienting perf gun shown in FIG. 45.

Figure 46:
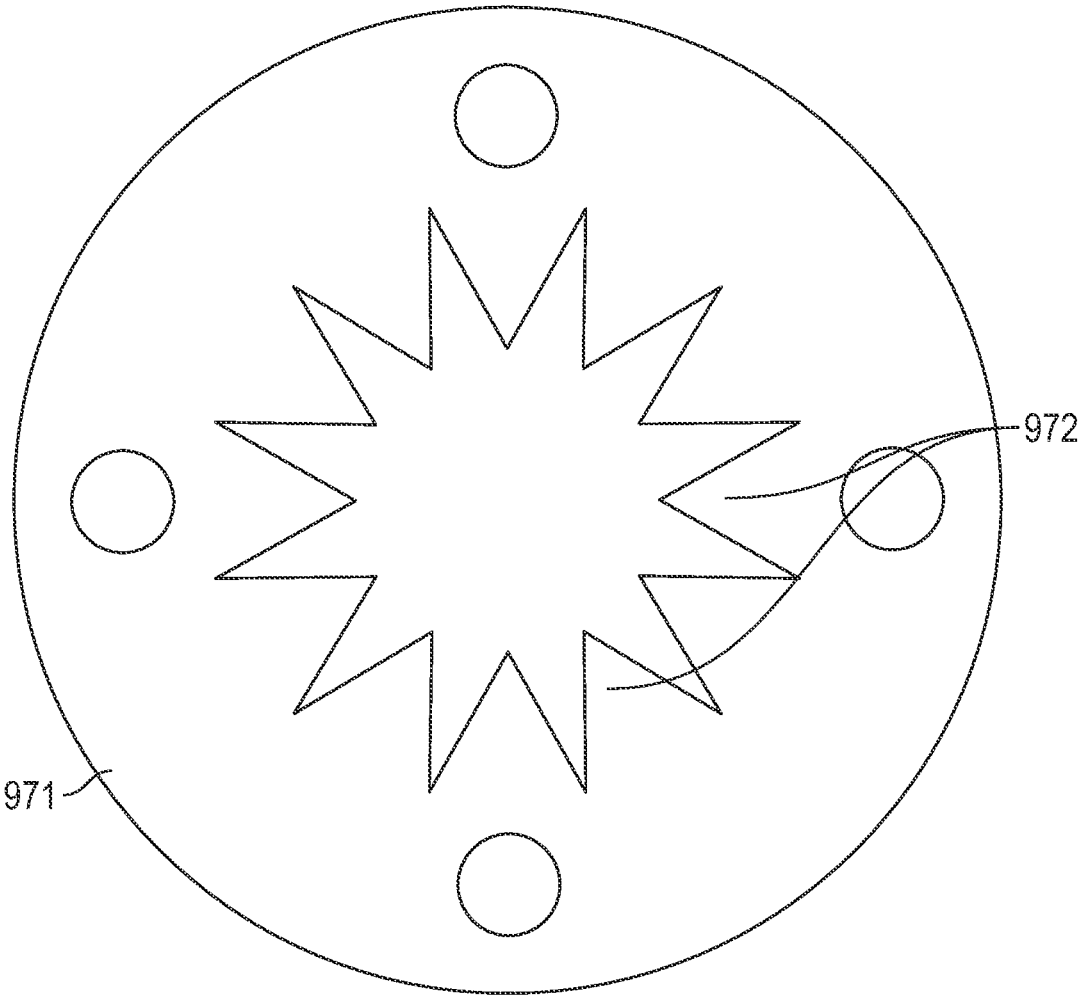
FIG. 46 is a front view of a disk-shaped ground brush.
Figure 47:
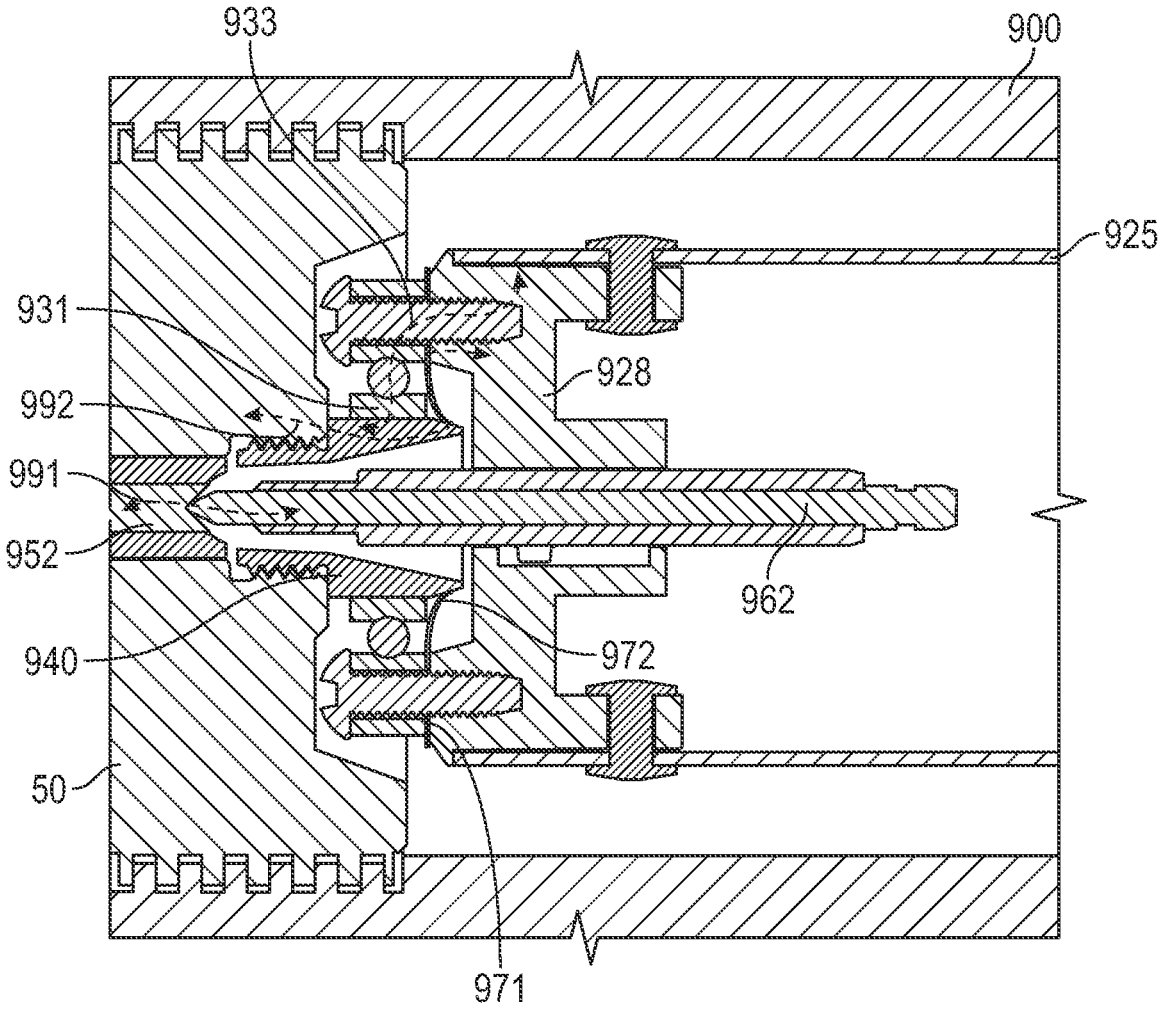
FIG. 47 is an enlarged, fragmentary cross-sectional view of a tandem sub and a perforating gun incorporating the ground brush of FIG. 46.

Turning now to FIGS. 46 and 47, an alternative electrical ground path arrangement is disclosed. As described above with respect to FIGS. 36-39, it has been found that a washer-shaped ground spring provides a reliable ground path from the tandem sub 50 to the end plate of the rotating assembly through the inner race of the bearing assembly of the perforating gun. FIG. 46 illustrates another embodiment of a disk-shaped ground spring or brush 971 that is different in arrangement and configuration from the ground spring 877 shown in FIGS. 36-39. Particularly, the ground brush 971 is provided with a generally centrally positioned void where the edge of the void are cut with facets to form at least one, but preferably multiple fingers 972 extending inwardly toward the center of the void.

FIG. 47 shows the ground brush 971 in a perforating gun. The perf gun in FIG. 47 includes an outer housing 900 with a tandem sub 50 attached to an end thereof. A support sub or hub 940 is attached to the sub 50 to support a charge carrier 925 of the perforating gun via a bearing located on the inside of a radially inner race 931 of a bearing assembly of the perforating gun. Ground brush 971 is arranged to be transverse to the axis of the perf gun and pinched between endplate 928 and a radially outer race 933 of the bearing assembly.

It may be noted that the fingers 972 ride on the periphery or, in other embodiments, on the end of the hub 940. In this exemplary embodiment, the fingers 972 of ground brush slidably contact an exterior frustoconical surface of the hub 940. While in this exemplary embodiment ground brush 971 contacts a frustoconical surface of hub 940, it may be understood that in other embodiments the ground brush 971 may instead contact an exterior cylindrical or other peripheral surface of the hub 940. Additionally, in this exemplary embodiment, endplate 928, ground brush 971, and hub 940 are each formed from electrically conductive materials whereby an uphole directed electrical ground path (indicated by arrow 992 in FIG. 47) is formed that extends through the endplate 928, ground brush 971, and hub 940. As such, the ground path illustrated by arrow 992 has a non-bearing based route from the endplate 928, through the ground brush 971 and into the hub 940 and into the sub 50. This ground path 992 is distinct and insulated from the signal path which is preferably routed along or near the axis from subbar 952 (also referred to herein as bulkhead electrical connector 952) into gun conductor pin 962 (also referred to herein as electrical pin connector 962) as shown by arrow 991 in FIG. 47. Bypassing or providing a parallel conductive path outside of the bearings may more reliable and consistent through vibrations of other guns being detonated. Also, providing the contact between the fingers 972 and the hub 940 in a manner where axial movement of the ground brush 971 relative to the hub 940 causes minimal deflection of the slightly bent fingers 972 whereas arranging the sliding interface to be at or slightly offset from a transverse plane is believed to be a more reliable arrangement.

Particularly, the ground path 992 extends longitudinally from the endplate 928 and into the ground brush 971 where the ground path 992 continues through the ground brush 971 and into the hub 940 via the sliding contact between the radially inner end of ground brush 971 and the frustoconical surface of hub 940. Further, from hub 940, ground path 992 extends into the tandem sub 50 where the ground path 992 may continue uphole towards an uphole end of the tool string comprising the ground brush 971. Additionally, it may be noted that FIG. 47 illustrates an electrical signal path 991 that is separate from and thus not in direct electrical contact with the ground path 992, and instead may travel downhole from the tandem sub 50 to the perforating gun comprising the ground brush 971. In some embodiments, ground path 992 comprises a primary ground path 992 while an electrical secondary ground path 993 is additionally formed extending through the bearing assembly (including outer race 933) rather than through the ground brush 971. In this configuration, ground paths 992 and 993 extend in parallel, primary ground path 992 traversing ground brush 971 and secondary ground path 993 traversing the bearing assembly.

During operation of the perforating gun, the charge carrier 925 comprising the endplate 928 and bearing assembly including radially outer race 933, may move longitudinally relative to a surrounding outer housing or sub 900 of the perforating gun. For instance, the charge carrier 925 may be rapidly displaced a small distance uphole relative to the outer housing 900 in response to the activation of a perforating gun located downhole from the perforating gun comprising charge carrier 925. The uphole movement of the charge carrier 925 may be arrested by contact between the charge carrier 925 and the tandem sub 50, such as contact between tandem sub 50 and the fasteners shown in FIG. 47. Additionally, the charge carrier 925 may rebound or recoil whereby the charge carrier 925 may in effect bounce off of the tandem sub 50 and travel slightly downhole relative to the outer housing 900 such that charge carrier 925 returns more or less to its original position. As the charge carrier 925 travels longitudinally (uphole and downhole) relative to the outer housing 900, the ground brush 971 slides along the frustoconical surface of hub 940, thereby maintaining electrical contact between the ground brush 971 and hub 940 such that the ground path 992 is maintained in spite of the relative longitudinal movement occurring between charge carrier 925 and outer housing 900.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A self-orienting perforating gun for creating one or more perforations through casing in a wellbore formed in a subterranean earthen formation, the perforating gun comprising:

an outer housing having a throughbore extending between longitudinally opposed housing ends thereof;

a charge carrier positioned in the throughbore of the outer housing wherein the charge carrier comprises an elongate body with a pair of longitudinally opposed carrier ends thereof and wherein the charge carrier includes one or more charge receptacles positioned between the opposed carrier ends;

a hub secured directly or indirectly to the outer housing at each of the opposed housing ends where the hub extends toward the charge carrier;

a bearing secured to each carrier end of the charge carrier wherein the bearing overlies the hub to provide a rotatable relationship between the hub and the charge carrier about a rotational axis within the outer housing; and an eccentric weight coupled to the charge carrier applying an off-axis orienting force to the charge carrier for urging the charge carrier to rotate about the rotational axis toward a predefined orientation relative to the direction of gravity.

2. The perforating gun of claim 1, wherein the bearing comprises a radially outer race fixed to the charge carrier, a radially inner race permitted to rotate relative to the radially outer race about the rotational axis, and one or more bearing elements positioned radially between the radially outer race and the radially inner race.

3. The perforating gun of claim 1, wherein the rotational axis is defined by the bearing.

4. The perforating gun of claim 1, wherein the eccentric weight comprises at least one segment of metal stock.

5. The perforating gun of claim 4, further comprising a weight harness shaped to secure the at least one segment of metal stock in a predefined position as part of the charge carrier such that the orienting force exceeds a resistance to rotation of the charge carrier for urging the charge carrier to rotate toward the predefined orientation.

6. The perforating gun of claim 4, wherein the eccentric weight comprises three or more distinct segments of the metal stock.

7. The perforating gun according to claim 1, further comprising:

a first electrical connector connected to the outer housing; and a second electrical connector connected to the charge carrier and rotatable relative to the first electrical connector, wherein the first and second connectors are in physical contact with one another such that the physical contact extends no further from the axis of rotation than 0.080 inches.

8. A self-orienting perforating gun for creating one or more perforations through casing in a wellbore formed in a subterranean earthen formation, the perforating gun comprising:

an outer housing having a throughbore extending between longitudinally opposed housing ends thereof and a hub fixed at each of the housing ends and located at least partially within the throughbore;

a charge carrier carried in the throughbore of the outer housing comprising a pair of longitudinally opposed carrier ends and defining one or more charge receptacles;

a bearing secured to the charge carrier such that the charge carrier may rotate relative to the outer housing about a rotational axis, wherein a first diameter is defined by an outer diameter of the outer housing and a second diameter, which is less than one half of the first diameter, is defined by a curved slip surface of the bearing located between a radially inner race and a radially outer race of the bearing, the slip surface being coaxial with the rotational axis; and an eccentric weight coupled to the charge carrier applying an orienting force to the charge carrier for urging the charge carrier toward a predefined orientation relative to the direction of gravity.

9. The self-orienting perforating gun according to claim 8, wherein the second diameter is less than 40% of the first diameter.

10. The self-orienting perforating gun according to claim 8, wherein a third diameter is defined by an outer diameter of the charge carrier and which is greater than the second diameter.

11. The self-orienting perforating gun according to claim 10, wherein the second diameter is less than 75% of the third diameter.

12. The self-orienting perforating gun according to claim 8, wherein a third diameter is defined by a center of mass of the combination of the charge carrier and the eccentric weight, and wherein the third diameter is greater than the second diameter.

13. A perforating assembly for forming one or more perforations through casing in a wellbore formed in a subterranean earthen formation, the perforating assembly comprising:

a tandem sub comprising:

a tandem housing having a throughbore extending between longitudinally opposed ends thereof;

a bulkhead electrical connector received in the throughbore of the tandem housing, the bulkhead electrical connector configured to provide pressure isolation across the throughbore of the tandem housing and comprising an electrical contact for forming an electrical connection across the bulkhead electrical connector; and a support hub substantially coaxially secured to the tandem housing;

a self-orienting perforating gun connectable to the tandem sub, the self-orienting perforating gun comprising:

an outer housing connectable to one of the ends of the tandem housing, the outer housing having a throughbore extending between longitudinally opposed ends thereof;

a charge carrier disposed in the throughbore of the outer housing comprising a pair of longitudinally opposed carrier ends and defining one or more charge receptacles positioned between the opposed carrier ends, wherein the one or more charge receptacles are configured to receive one or more explosive charges, and wherein the weight of the charge carrier is supported by the tandem sub when the perforating gun is connected to the tandem sub;

a bearing physically supported by the support hub and secured to the charge carrier such that rotation is permitted of the charge carrier relative to the outer housing about a rotational axis; and an eccentric weight coupled to the charge carrier applying an orienting force to the charge carrier for urging the charge carrier toward a predefined orientation relative to the direction of gravity.

14. The perforating assembly according to claim 13, wherein the bearing and the eccentric weight define a rotatable weight of the perforating assembly.

15. The perforating assembly according to claim 14, wherein the bearing is formed integrally with the eccentric weight.

16. The perforating assembly according to claim 14, wherein a radially outer race of the bearing connects directly to the eccentric weight.

17. The perforating assembly according to 13, wherein the support hub is supported by the outer housing.

18. The perforating assembly according to claim 13, wherein the bearing has a bearing diameter measured from one edge of a slip surface to the opposite edge of the slip surface, and the bearing diameter is less than 40 millimeters (mm).

19. The perforating assembly according to claim 18, wherein the bearing diameter is less than 35 mm.

20. The perforating assembly according to claim 19, wherein the bearing diameter is at least 15 mm and less than 30 mm.

21. A self-orienting perforating gun for creating one or more perforations through casing in a wellbore formed in a subterranean earthen formation, the perforating gun comprising:

an outer housing having a throughbore extending between longitudinally opposed housing ends thereof;

a charge carrier positioned in the throughbore of the outer housing wherein the charge carrier comprises an elongate body with a pair of longitudinally opposed carrier ends thereof and wherein the charge carrier includes one or more charge receptacles positioned between the opposed carrier ends and configured to receive one or more explosive charges, wherein the charge carrier defines an inner support surface in which an external support hub is insertable to physically support the charge carrier in the outer housing;

an axis of rotation for the charge carrier to rotate within the throughbore of the outer housing;

a first electrical connector connected to the outer housing; and a second electrical connector connected to the charge carrier and rotatable about the axis of rotation relative to the first electrical connector, wherein the first and second connectors are in physical contact with one another such that the physical contact extends no further from the axis of rotation than 0.080 inches.

22. The perforating gun according to claim 21, further comprising an endplate for attaching to one end of the charge carrier and comprises an axis oriented parallel with the elongate body of the charge carrier along with features formed on and into the endplate, and wherein all of the features formed on and into the endplate have a direction of draw parallel to the axis of the endplate.

23. The perforating gun according to claim 21, further comprising eccentrically mounted weight bars axially displaced from the explosive charge and a weight cap arranged to support the weight bars at an end of the weight bars closest to the one or more explosive charges.

24. The perforating gun according to claim 23, wherein the weight cap includes a blast plate between the ends of the weight bars located between the weight bars and the weight cap to provide a barrier against an activation from the one or more explosive charges.

25. The perforating gun according to claim 23, wherein the weight cap includes alignment tabs comprising a first arc of tabs and a separate second arcs of tabs wherein both the first arc of tabs and the second arc of tabs have a shared central axis and the first arc of tabs is arranged at a first radius from the shared central axis and the second arc is arranged to have a larger diameter from the shared central axis.

* * * * *